US011168502B2

(12) United States Patent
Oshima et al.

(10) Patent No.: US 11,168,502 B2
(45) Date of Patent: Nov. 9, 2021

(54) DOOR DEVICE

(71) Applicant: SUGATSUNE KOGYO CO., LTD., Tokyo (JP)

(72) Inventors: Kazuyoshi Oshima, Tokyo (JP); Masaya Suzuki, Tokyo (JP); Tadashi Iijima, Tokyo (JP); Mitsuru Sugiura, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 74 days.

(21) Appl. No.: 16/616,812

(22) PCT Filed: May 16, 2018

(86) PCT No.: PCT/JP2018/018888
§ 371 (c)(1),
(2) Date: Nov. 25, 2019

(87) PCT Pub. No.: WO2018/216564
PCT Pub. Date: Nov. 29, 2018

(65) Prior Publication Data

US 2021/0172229 A1 Jun. 10, 2021

(30) Foreign Application Priority Data

May 24, 2017 (JP) ..... JP2017-102850

(51) Int. Cl.
*E05F 1/08* (2006.01)
*E05F 1/12* (2006.01)
(Continued)

(52) U.S. Cl.
CPC ..... *E05F 1/1246* (2013.01); *E05D 3/18* (2013.01); *E05D 7/00* (2013.01);
(Continued)

(58) Field of Classification Search
CPC ..... Y10T 16/53822; Y10T 16/5383; Y10T 16/53834; Y10T 16/5384; Y10T 16/5389;
(Continued)

(56) References Cited

U.S. PATENT DOCUMENTS 3,256,554 A * 6/1966 Turner ..... E05F 1/1261 16/273
3,737,947 A * 6/1973 Little ..... E05F 1/1261 16/290

(Continued)

FOREIGN PATENT DOCUMENTS

CN 104695789 A 6/2015
DE 19 54 811 A1 5/1971

(Continued)

OTHER PUBLICATIONS

Office Action issued in Taiwanese Patent Application No. 107116814 dated Dec. 8, 2020 with partial English machine translation provided.

(Continued)

*Primary Examiner* — Chuck Y Mah
(74) *Attorney, Agent, or Firm* — Nixon & Vanderhye

(57) ABSTRACT

Disclosed is a door device that can ensure necessary catch function and/or assist function and give a neat impression is provided. The hinge includes a first part to be attached to a main body and a second part to be attached to a door. The door device includes a base, an arm rotatably supported on the base and a spring for applying torque to the arm in the closing direction and/or in the opening direction thereof. The base of the door device is attached to the first part of the hinge.

18 Claims, 25 Drawing Sheets

(51) Int. Cl.
*E05D 3/18* (2006.01)
*E05D 7/00* (2006.01)

(52) U.S. Cl.
CPC ... *E05Y 2201/484* (2013.01); *E05Y 2201/638* (2013.01); *E05Y 2900/20* (2013.01)

(58) Field of Classification Search
CPC .... Y10T 16/304; E05F 1/1246; E05F 1/1253; E05F 1/1261; E05D 3/18; E05D 3/183; E05D 7/00; E05D 7/0009; E05D 7/0415; E05D 7/0423; E05Y 2201/484; E05Y 2201/496; E05Y 2201/638; E05Y 2900/20
See application file for complete search history.

(56) References Cited

U.S. PATENT DOCUMENTS 3,763,519 A * 10/1973 Favre ..... E05F 1/105 16/72
3,906,587 A * 9/1975 Little ..... E05F 1/1261 16/289
4,658,473 A * 4/1987 Schema ..... E05F 1/1261 16/286
4,773,125 A 9/1988 Watabe
4,837,894 A * 6/1989 Lin ..... E05D 3/16 16/288
5,271,652 A * 12/1993 Watanabe ..... B62D 33/03 105/378
5,272,789 A * 12/1993 Mitchell ..... E05F 1/1284 16/278
7,275,284 B2 * 10/2007 Lautenschlager ..... E05D 3/142 16/287
7,406,749 B2 * 8/2008 Herper ..... E05F 5/006 16/286
7,886,408 B2 * 2/2011 Lautenschlager ..... E05F 5/006 16/286
7,987,558 B2 * 8/2011 Beckmann ..... E05D 11/0054 16/366
8,205,298 B2 * 6/2012 Lin ..... E05F 5/006 16/287
8,256,064 B2 * 9/2012 Blersch ..... E05D 3/18 16/286
8,482,906 B2 * 7/2013 Farley, Jr. ..... E05F 1/1091 361/679.01
8,894,162 B2 * 11/2014 Kashiwaguma ..... E05F 1/1058 312/319.2
8,904,600 B2 * 12/2014 Sugasawara ..... E05D 15/34 16/366
9,080,365 B2 * 7/2015 Collene ..... E05F 1/1261
9,157,262 B2 * 10/2015 Lee ..... D06F 39/14
9,169,681 B2 * 10/2015 Cooper ..... E05F 5/006
9,353,562 B2 * 5/2016 Oshima ..... E05F 5/02
9,777,525 B2 * 10/2017 Salice ..... E05D 3/16
10,203,149 B2 * 2/2019 Liu et al. ..... E05F 5/006 16/298
2005/0177980 A1 * 8/2005 Herper ..... E05D 3/06 16/366
2007/0257538 A1 * 11/2007 Brunnmayr ..... E05D 15/262 297/423.12
2008/0098565 A1 * 5/2008 Migli ..... E05F 5/006 16/239
2008/0172833 A1 * 7/2008 Migli ..... E05D 15/40 16/277
2008/0209682 A1 * 9/2008 Dubach ..... A61K 8/9789 16/319
2008/0235996 A1 * 10/2008 Evans ..... E01H 5/062 37/232
2008/0238276 A1 * 10/2008 Migli ..... E05F 15/614 312/326
2009/0056074 A1 * 3/2009 Chase ..... E05D 7/06 16/321
2009/0165244 A1 * 7/2009 Pyo ..... E05F 5/02 16/250
2013/0180081 A1 * 7/2013 Salice ..... E05F 1/10 16/64
2015/0096147 A1 4/2015 Rohner et al.
2015/0240546 A1 8/2015 Oshima et al.
2015/0361699 A1 12/2015 Manzoni
2018/0209193 A1 7/2018 Hammerer
2018/0298661 A1 * 10/2018 Salice ..... E05F 1/1058

FOREIGN PATENT DOCUMENTS

DE 3638994 A1 * 8/1988 ..... E05D 11/105
EP 0 292 610 A1 11/1988
EP 2 924 215 A1 9/2015
EP 2 622 159 B1 6/2020
GB 1364760 A * 8/1974 ..... E05F 1/1261
JP 2007-308914 A 11/2007
JP 4198651 B2 * 12/2008
JP 2009-228381 A 10/2009
JP 2014-503041 A 2/2014
JP 2014-510861 A 5/2014
KR 10-1381188 B1 4/2014
TW M306611 U 2/2007
WO 2014/050749 A1 4/2014
WO 2014/128248 A1 8/2014
WO 2017/006662 A1 1/2017
WO 2017/059470 A1 4/2017

OTHER PUBLICATIONS

International Search Report (ISR), dated Aug. 7, 2018, from corresponding international application No. JCT/JP2018/018888.
Office Action issued in Indian Patent Application No. 201917044695 dated Jan. 14, 2021.
Extended European Search Report issued in European Patent Application No. 18806738.3 dated Jan. 22, 2021.

* cited by examiner

DOOR DEVICE

TECHNICAL FIELD

The present invention relates to a door device for applying torque to a door in a closing direction and/or an opening direction thereof which is rotatably attached to a main body via a hinge.

BACKGROUND ART

Doors are rotatably attached to main bodies of furniture, storage and buildings and the like via hinges. As a kind of hinge, a slide hinge composed of a four-link mechanisms is known (see Patent Document 1). The slide hinge includes a first part to be attached to the main body, a second part to be attached to the door, and two links rotatably connected to the first part and the second part.

The slide hinge is provided with a spring for applying torque to the door. This is because a catch function for holding the door in the closed position and/or the open position is added, or an assist function for opening the door with a slight force is added. The spring is, for example, a torsion spring, and is provided between the first part and the link or between the second part and the link for applying torque to the link.

PRIOR ART DOCUMENTS

Patent Literature

Patent Document 1: JP 2007-308914 A

SUMMARY OF THE INVENTION

Problems to be Solved by the Invention

However, in the conventional slide hinge, since the spring is arranged in a limited space of the slide hinge, it is difficult to increase the force of the spring. Further, in the case where the door is heavy or the door is an upwardly open type in which a large moment is applied, there is a problem that a necessary catch function and/or assist function cannot be obtained.

In order to solve these problems, it is conceivable to provide a door device for applying torque to the door in combination with the slide hinge. However, when the door device is used in combination with the slide hinge, there are two separate mechanical parts, which result in problems such as poor appearance, a small storage space, and troublesome in mounting thereof.

Therefore, an object of the present invention is to provide a door device that can ensure a necessary catch function and/or assist function and can provide a neat impression.

Means for Solving the Problem

In order to solve the above-described problems, the present invention provides a door device for applying torque to a door in a closing direction and/or an opening direction thereof, the door being rotatably attached to a main body via a hinge, which comprises a base, an arm rotatably supported on the base, and biasing means for applying torque to the arm in a closing direction and/or an opening direction thereof, wherein the hinge comprises a first part to be attached to one of the main body or the door, and a second part to be attached to the other one of the main body or the door, wherein the base is attached to the first part of the hinge and wherein the arm is connected to the other one of the main body or the door.

The Effects of the Invention

According to the present invention, since the base of the door device is attached to the first part of the hinge, the hinge and the door device can be integrated, and thus a neat impression can be provided. Further, since the biasing means is provided in the door device, the range of selection of the biasing means is widened, and thus a necessary catch function and/or assist function can be ensured.

BRIEF DESCRIPTION OF THE DRAWINGS

FIG. 3 is a view showing a state in which the door device of the present embodiment is attached to the hinge

FIG. 5 is an operation diagram of the door device of the present embodiment

FIG. 19 is a sectional view of the arm showing how to adjust the spring force

BEST MODE FOR CARRYING OUT THE INVENTION

Hereinafter, embodiments of the door device of the present invention will be described in detail with reference to the accompanying drawings. However, the door device of the present invention can be embodied in various forms, and is not limited to the embodiments described in the present specification. The embodiments are provided with the intention of enabling those skilled in the art to fully understand the scope of the invention by sufficient disclosures of the specification.

First Embodiment

Figure 1:
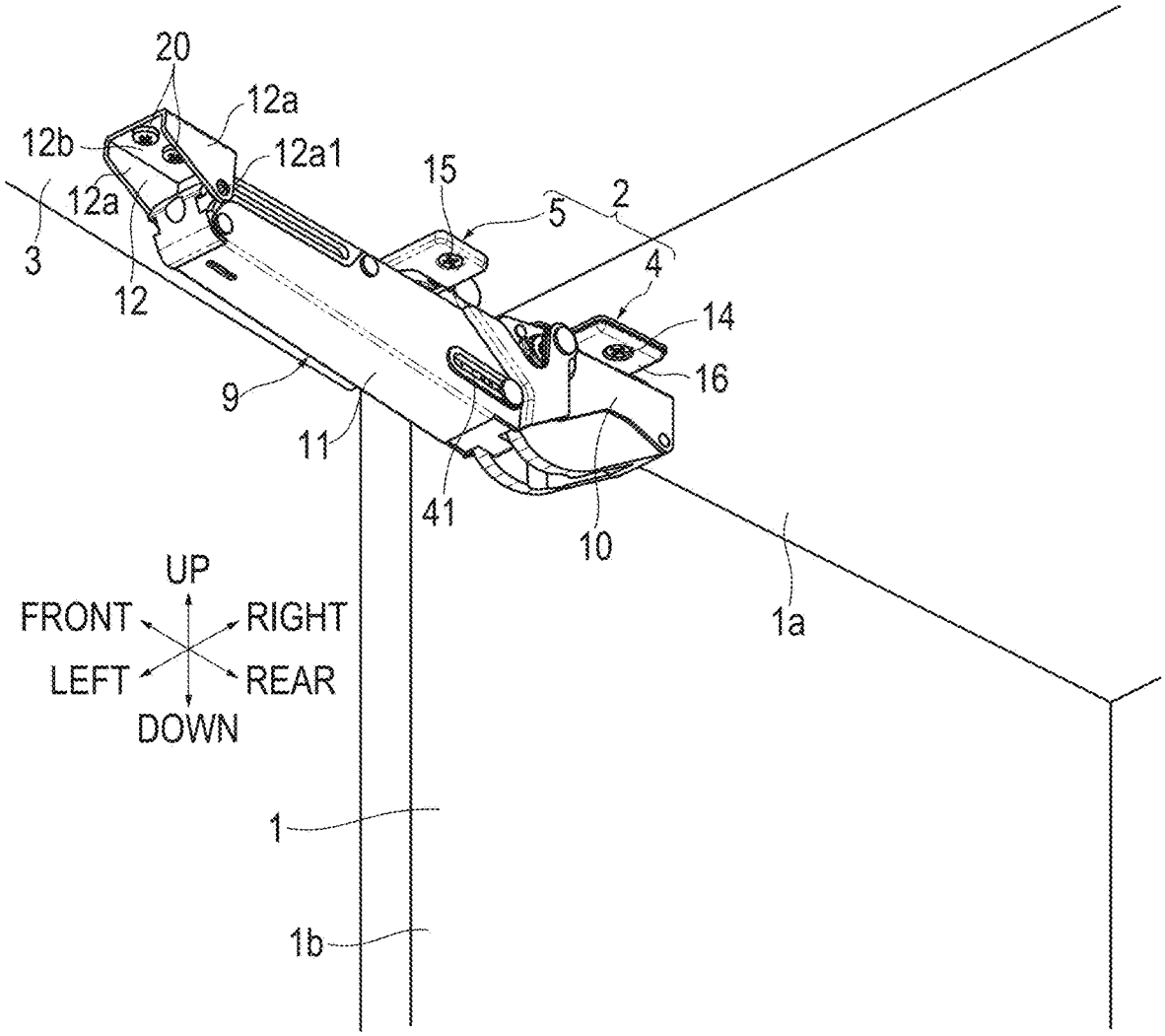
FIG. 1 is a perspective view of a door device according to a first embodiment of the present invention.

FIG. 1 shows a state in which the door device according to the first embodiment of the present invention is attached to a main body of furniture with a hinge. A door 3 is attached to the furniture body 1 through a slide hinge 2 (hereinafter simply referred to as a hinge 2) so as to be opened and closed. The door 3 is an upwardly open type door and is rotated around the horizontal axis from the closed position to the open position by the hinge 2. FIG. 1 shows the open position of the door 3. The hinge 2 includes a first part 4 to be attached to the main body 1 and a second part 5 to be attached to the door 3. The first part 4 and the second part 5 are connected via two links 7 and 8 (see FIG. 3B). The door device 9 includes a base 10 and an arm 11 that is rotatably supported by the base 10. The base 10 is attached to the first part 4 of the hinge 2 and to be attached to the main body 1 via the first part 4. The tip of the arm 11 is connected to the door 3 through a seat 12. The seat 12 and the second part 5 are apart from each other in the lengthwise direction of the arm 11. The arm 11 is not attached to the second part 5.

In the following, for convenience of explanation, the configuration of the door device 9 will be described using the directions when the main body 1 is viewed from the front, that is, the front-rear direction, the left-right direction, and the up-down direction (vertical direction) shown in FIG. 1. Of course, the arrangement of the door device 9 is not limited to such an arrangement.

The main body 1 includes a top plate 1*a*, a pair of left and right side plates 1*b*, and a bottom plate (not shown). The first part 4 of the hinge 2 is attached to the top plate 1*a* using first screws 14. The second part 5 of the hinge 2 is attached to the door 3 using second screws 15. The seat 12 is attached to the door 3 using third screws 20.

Figure 2:
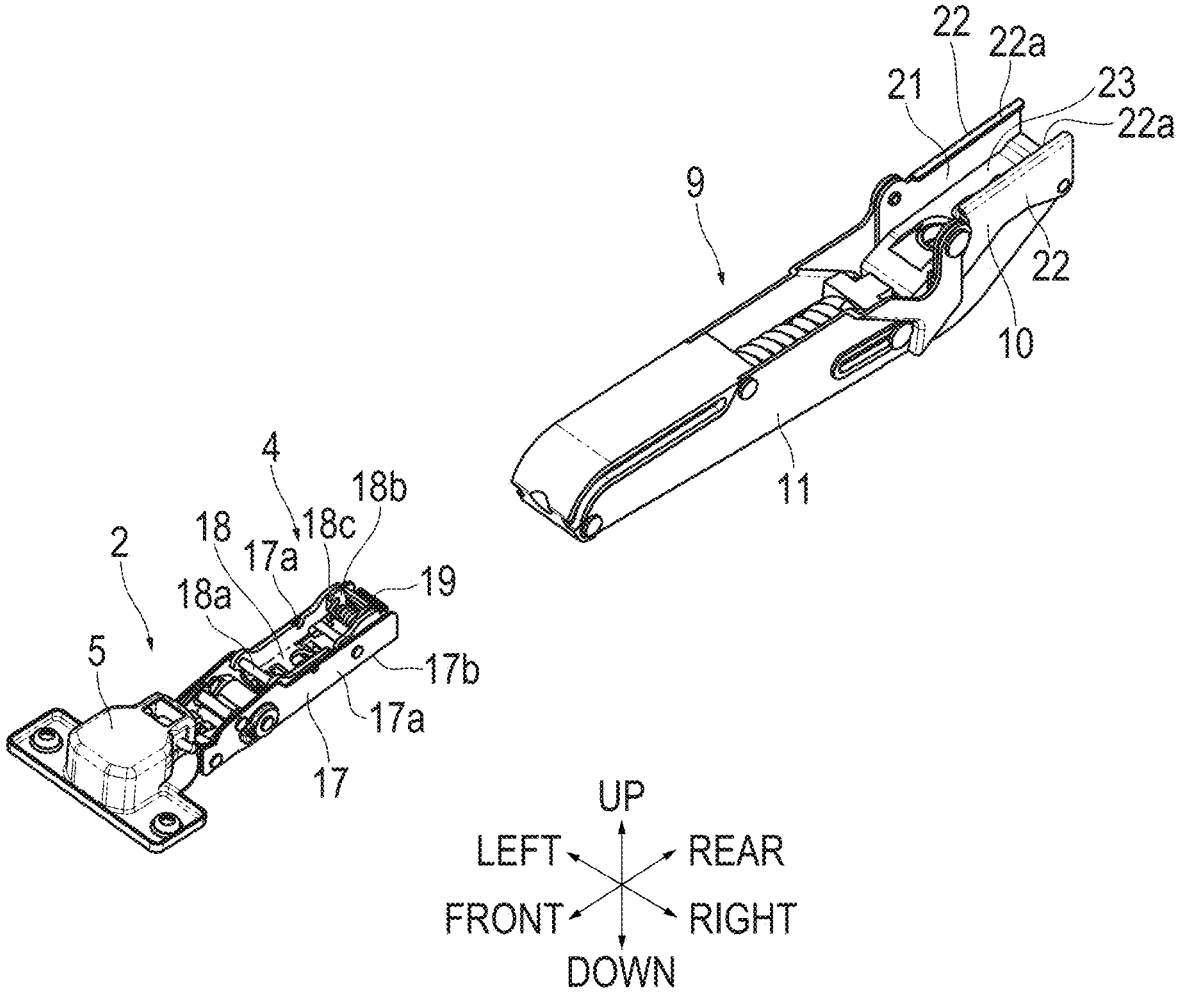
FIG. 2 is an exploded perspective view of the door device and the hinge according to the present embodiment.

FIG. 2 shows an exploded perspective view of the door device 9 and the hinge 2. The first part 4 (see also FIG. 1) of the hinge 2 includes a mounting seat 16 (see FIG. 1) attached to the main body 1 and a first part main body 17 removably attached to the mounting seat 16 with one touch (see FIG. 2). The first part main body 17 has a pair of left and right side plates 17*a* facing each other and a connecting plate 17*b* connecting the side plates 17*a*, and has a substantially U-shaped cross section. The first part main body 17 is long in the front-rear direction. An intermediate plate 18 is incorporated in the first part main body 17. The intermediate plate 18 has also a U-shaped cross section. A shaft 18*a* is provided at the front end of the intermediate plate 18, and a rotatable hook 18*b* urged in the closing direction by a torsion spring 18*c* is provided at the rear end of the intermediate plate 18. When the first part main body 17 is pushed over the mounting seat 16, the shaft 18*a* of the intermediate plate 18 is fitted into a notch (not shown) of the mounting seat 16, and the hook 18*b* is closed after temporarily opened, and the hook 18*b* is fitted into a notch (not shown) of the mounting seat 16. As a result, the first part main body 17 is attached to the mounting seat 16 with one touch. To remove the first part main body 17 from the mounting seat 16, a lever 19 is pushed and the hook 18*b* is rotated in the opening direction. The second part 5 is cup-shaped.

The base 10 of the door device 9 is provided with a concave portion 21 in which the first part main body 17 is fitted so as to be slidable in the front-rear direction. The concave portion 21 is defined by a pair of left and right side walls 22 corresponding to the pair of left and right side plates 17*a* of the first part main body 17, a base body 23 corresponding to the connecting plate 17*b* of the first part main body 17, and a pair of bent portions 22*a* that are provided on and bent at the upper end portions of the pair of side walls 22 so as to sandwich the pair of side plates 17*a* in the vertical direction together with the base body 23.

Figure 3A:
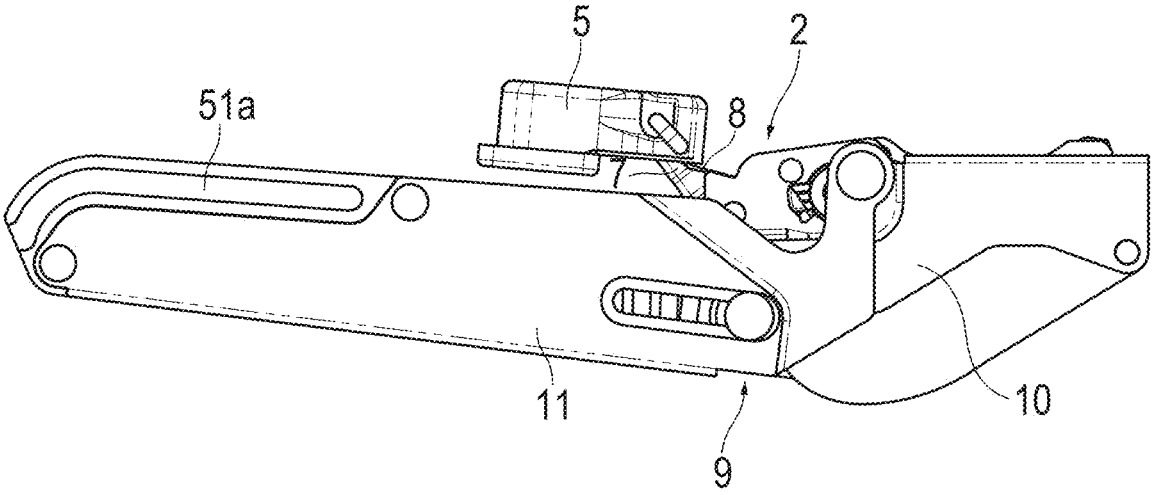
(FIG. 3A is a side view.
Figure 3B:
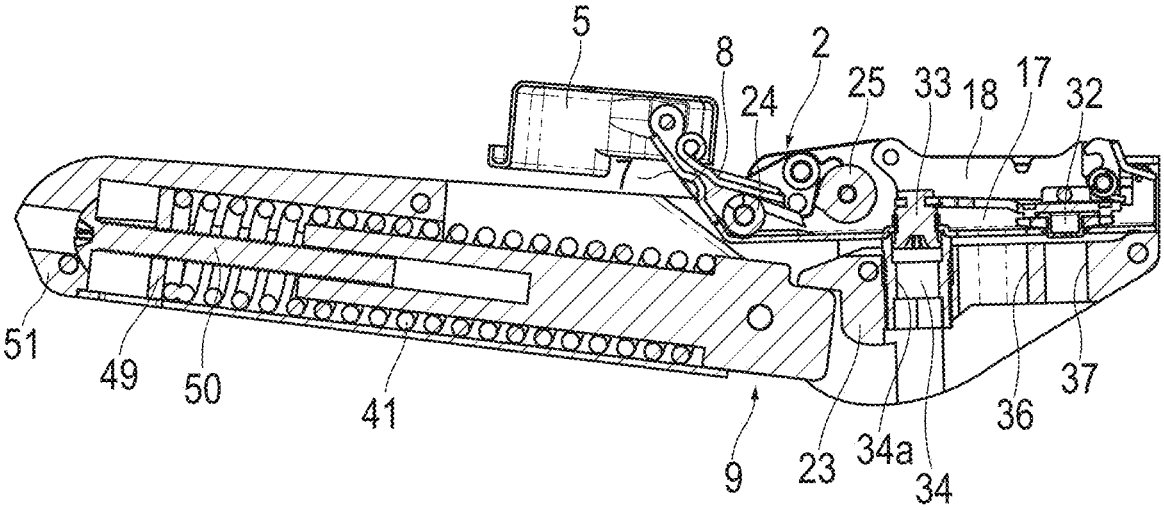
FIG. 3B is a sectional view).

FIG. 3 shows a state in which the door device 9 is attached to the first part main body 17 of the hinge 2. As shown in the sectional view of FIG. 3B, the first part main body 17 and the second part 5 are connected via two links, that is, the inner link 7 and the outer link 8. The first part 4, the second part 5, the inner link 7 and the outer link 8 constitute a four node rotating chain, and these are rotatably connected to each other. Between the first part 4 and the outer link 8, there is a torsion spring 24 for holding the door 3 in the closed position. Further, the outer link 8 is provided with a damper 25 that contacts the outer link 8 when the door 3 is closing, brakes the rotation of the outer link 8, and thus closes the door 3 slowly. As will be described later, the door device 9 is also provided with a catch function. For this reason, the torsion spring 24 of the hinge 2 may be omitted.

Figure 8:
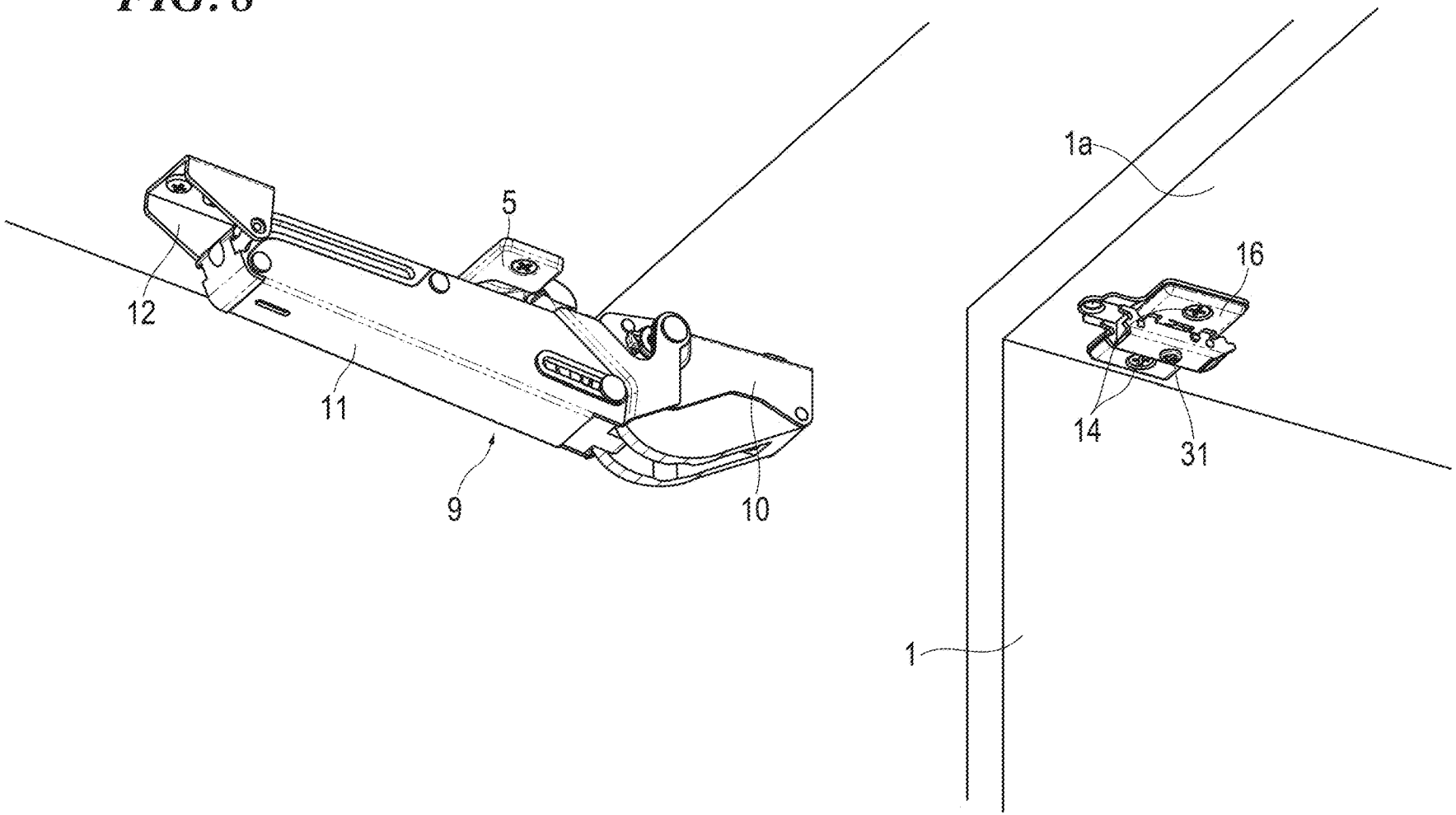
FIG. 8 is a process diagram of a method for attaching the door device of the present embodiment.

In order to be able to adjust the front-rear, left-right, and up-down positions of the door 3, the first part main body 17 can be adjusted to the front-rear, left-right, and up-down (vertical) positions on the mounting seat 16 (see also FIGS. 1 and 8). By rotating the left-right adjustment screw 31 shown in FIG. 8, it is possible to adjust the left-right position of the first part main body 17 and thereby the left-right position of the door 3. Further, by rotating the front-rear adjustment screw 32 shown in FIG. 3B, it is possible to adjust the front-rear position of the first part main body 17 relative to the intermediate plate 18 and thereby the front-rear position of the door 3. Furthermore, by rotating the vertical adjustment screw 33 shown in FIG. 3B, it is possible to adjust the vertical position of the first part main body 17 with respect to the intermediate plate 18, and thereby the vertical position of the door 3.

In the base body 23 of the door device 9, a cylindrical set screw 34 is screwed. In a state that the first part main body 17 is fitted in the concave portion 21 (see FIG. 2) of the base 10 in the front-rear direction, the set screw 34 is screwed and the set screw 34 covers the vertical adjustment screw 33 of the first part main body 17. As a result, the first part main body 17 cannot be moved in the front-rear direction, and the first part main body 17 is attached to the base 10. In this way, the first part main body 17 is attached to the base 10, and the first part main body 17 can be attached to and detached from the mounting seat 16. The base body 23 is provided with access openings 36 and 37 such as holes or notches so that the position adjustment screws 31 and 32 can be rotated in a state that the first part main body 17 is mounted on the mounting seat 16. The set screw 34 is also provided with an access opening 34*a* so that the adjustment screw 33 can be rotated.

Figure 4:
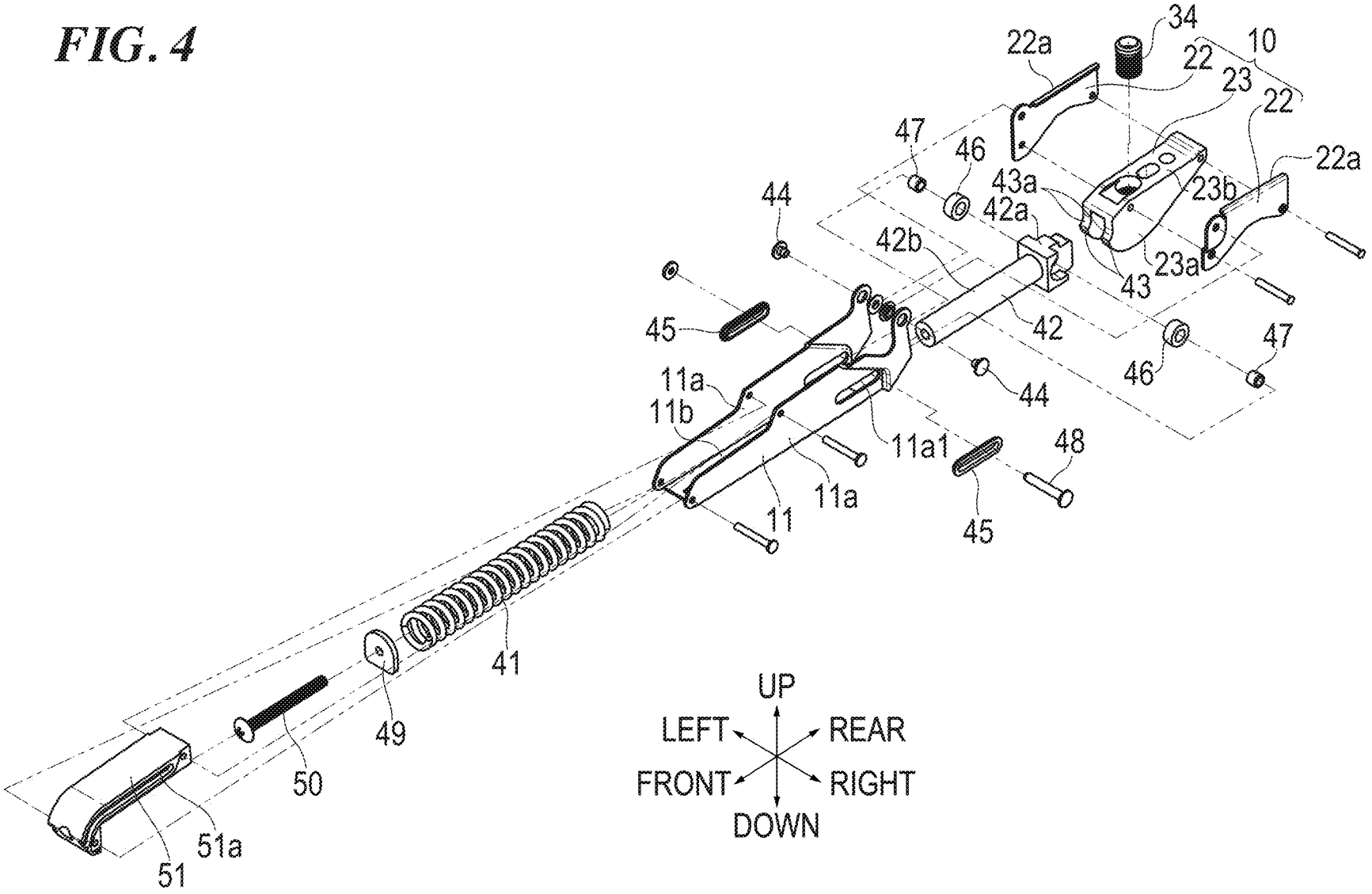
FIG. 4 is an exploded perspective view of the door device of the present embodiment.

FIG. 4 shows an exploded perspective view of the door device 9. The door device 9 includes the base 10, the arm 11 rotatably supported by the base 10, and a spring 41 as the biasing means for applying closing direction and opening direction torque to the arm 11. The arm 11 is provided with a slider 42 that can slide in the lengthwise direction of the arm 11. The slider 42 is biased to a cam 43 of the base 10 by the spring 41. The cam 43 converts the force with which the spring 41 presses the slider 42 into torque that rotates the arm 11.

The base 10 includes the base body 23 on which the cam 43 is formed, and the pair of left and right side walls 22 respectively attached to the left and right side surfaces of the base body 23. The base body 23 has a pair of left and right side plate portions 23*a* facing each other and a connecting plate portion 23*b* that connects the side plate portions 23*a* so as to have a U-shaped cross section. The cam 43 is formed on the side plate portions 23*a* of the base body 23 and has a substantially arc shape. A recess 43*a* for keeping the door 3 in the open position is formed in a part of the cam 43. The set screw 34 is screwed into the base body 23. Each of the pair of side walls 22 has a plate shape. A pair of bent portions 22*a* projecting toward each other are respectively formed at the upper end portions of the pair of side walls 22.

The shape of the cam 43 is formed so as to have at least one of a catch function that applies closing direction torque to the door 3 in which the door device 9 is in the closed position, an assist function that applies opening direction torque to the door 3 so that the door 3 can be opened with a slight force, a free stop function that stops the door 3 at an arbitrary opening angle, and a catch function that keeps the door 3 in the open position.

The arm 11 is elongated in the front-rear direction. The arm 11 includes a pair of left and right side plates 11*a* facing each other and a connecting plate 11*b* that connects the side plates 11*a* so as to have a U-shaped cross section. The rear end portions of the side plates 11*a* of the arm 11 are rotatably supported on the side walls 22 of the base 10 via shafts 44, respectively. A long hole 11*a*1 for guiding the slider 42 is formed in each of the side plates 11*a* of the arm 11. Long rectangular frame-shaped guide bodies 45 are fitted into the long holes 11*a*1, respectively.

The arm 11 is provided with a shaft-like slider 42 so as to be slidable in the lengthwise direction of the arm 11. Rollers 46 are rotatably supported on the head 42*a* of the slider 42. A pin 48 is passed through the head 42*a* of the slider 42. The rollers 46 are rotatably supported by the pin 48 via roller collars 47, respectively. The pin 48 is also passed through the guide bodies 45. The head 42*a* of the slider 42 is guided to the guide bodies 45 through the pin 48.

The arm 11 houses a coiled spring 41 therein. The length of the spring 41 extends over substantially the entire length of the arm 11. The spring 41 is disposed so as to surround a shaft portion 42*b* of the slider 42, and biases the rollers 46 of the head portion 42*a* against the cam 43. A spring receiver 49 abuts on one end of the spring 41. A screw 50 is screwed into the spring receiver 49. An L-shaped plate-like spring case 51 is fixed to the tip of the arm 11. The head of the screw 50 abuts against the spring case 51. By rotating the screw 50, the spring receiver 49 moves in the lengthwise direction of the arm 11, and the force of the spring 41 is adjusted. The screw 50 is inserted into the hole of the shaft portion 42*b* of the slider 42. The slider 42 has the head 42*a* guided to the guide bodies 45 of the arm 11 via the pin 48, and the shaft portion 42*b* is guided by the screw 50.

The spring case 51 is formed with a groove 51*a* that extends in the lengthwise direction of the arm 11 and whose tip is curved downward so as to have an arc shape. As shown in FIG. 1, the seat 12 attached to the door 3 includes a pair of left and right side plate portions 12*a* and a connecting plate portion 12*b* that connects the side plate portions 12*a* so as to have a U-shaped cross section. Small-diameter circular protrusions 12*a*1 (see FIG. 6) are respectively formed on the inner surfaces of the side plate portions 12*a* of the seat 12. The protrusions 12*a*1 are slidably and rotatably fitted in the groove 51*a* of the spring case 51.

Figure 5A:
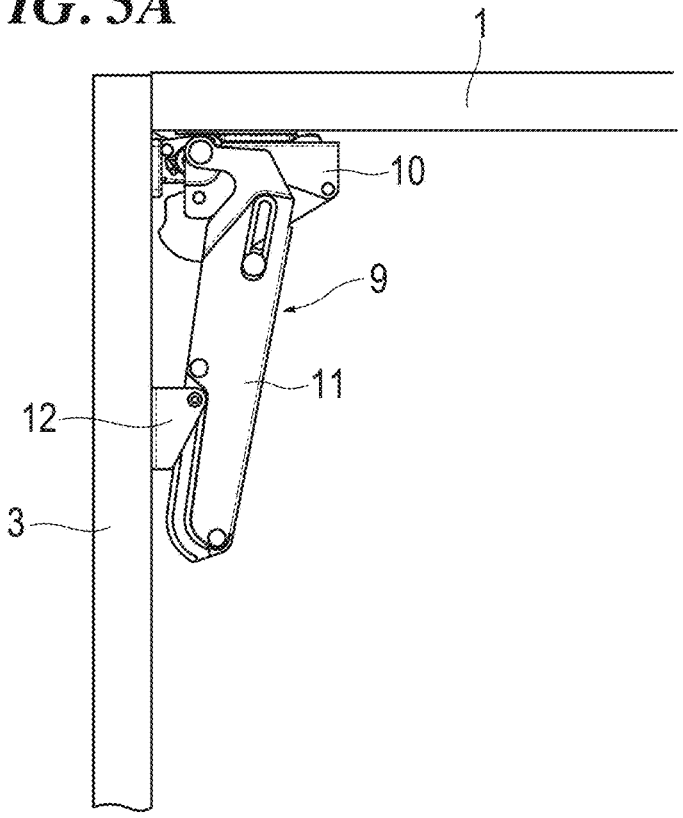
(FIG. 5A shows a closed position of the door.
Figure 5B:
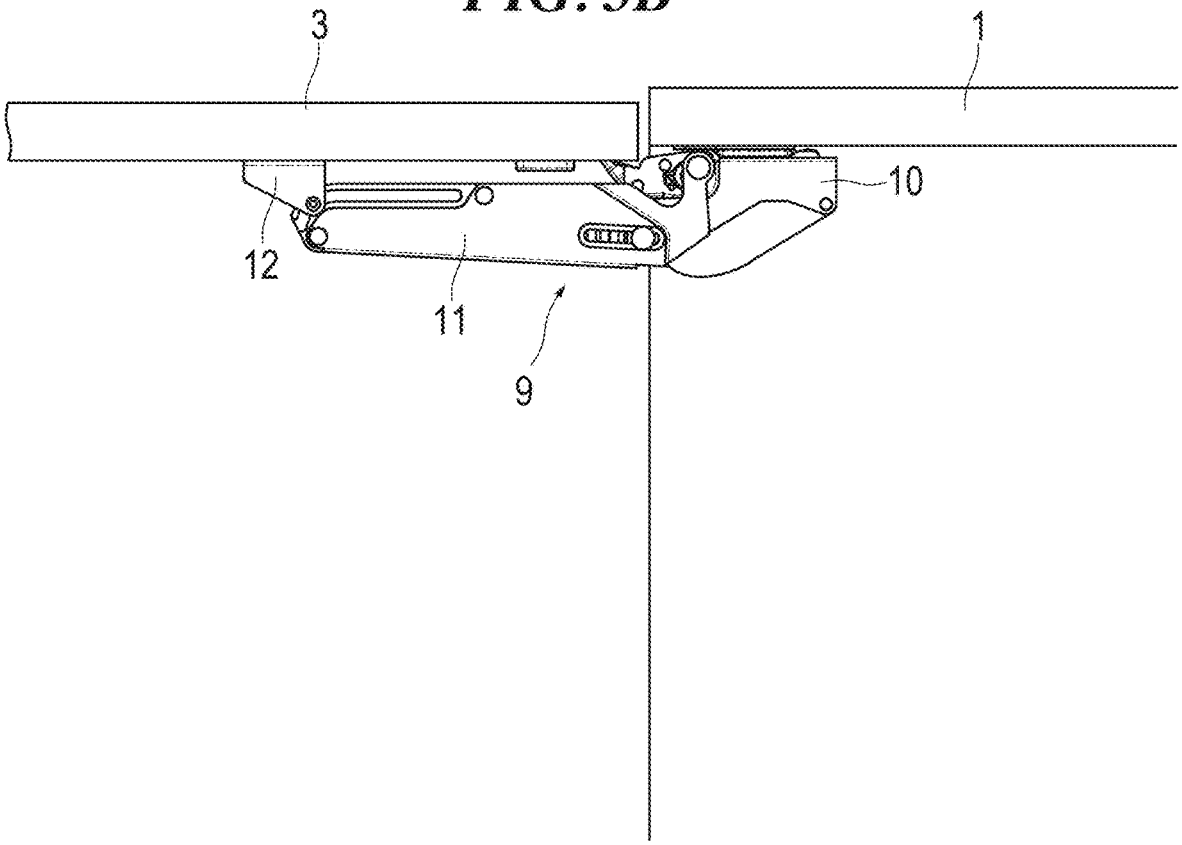
FIG. 5B shows an open position of the door).

FIG. 5A shows the closed position of the door 3, and FIG. 5B shows the open position of the door 3. As shown in FIG. 5A, when the door 3 is in the closed position, the arm 11 is substantially parallel to the door 3, and the door 3 is kept in the closed position by the catch function of the door device 9.

When the door 3 is opened, the arm 11 rotates in the opening direction while maintaining a state substantially parallel to the door 3, and the seat 12 starts to slide toward the tip of the arm 11. When the door 3 is opened by a predetermined angle or more, the door 3 can be opened with a slight force by the assist function of the door device 9. Further, the door 3 keeps an arbitrary opening angle even if the hand is released from the door 3 by the free stop function of the door device 9.

As shown in FIG. 5B, when the door 3 is opened to the open position, the arm 11 is rotated in a substantially horizontal direction while maintaining a state substantially parallel to the door 3. The seat 12 slides to substantially a tip of the arm 11. When the door 3 is rotated to the open position, the rollers 46 of the slider 42 are fitted into the recesses 43*a* of the cam 43 (see FIG. 4), and the open position of the door 3 is maintained by the catch function of the door device 9.

When the door 3 is closed from the open position, the operation is reverse to that described above. When the door 3 is closed to a predetermined angle, the door 3 is automatically closed by the catch function of the door device 9. At this time, the damper 25 of the hinge 2 (see FIG. 3B) is activated, and the door 3 is slowly closed. Note that the damper 25 can be provided in the door device 9 instead of the hinge 2.

Figure 6:
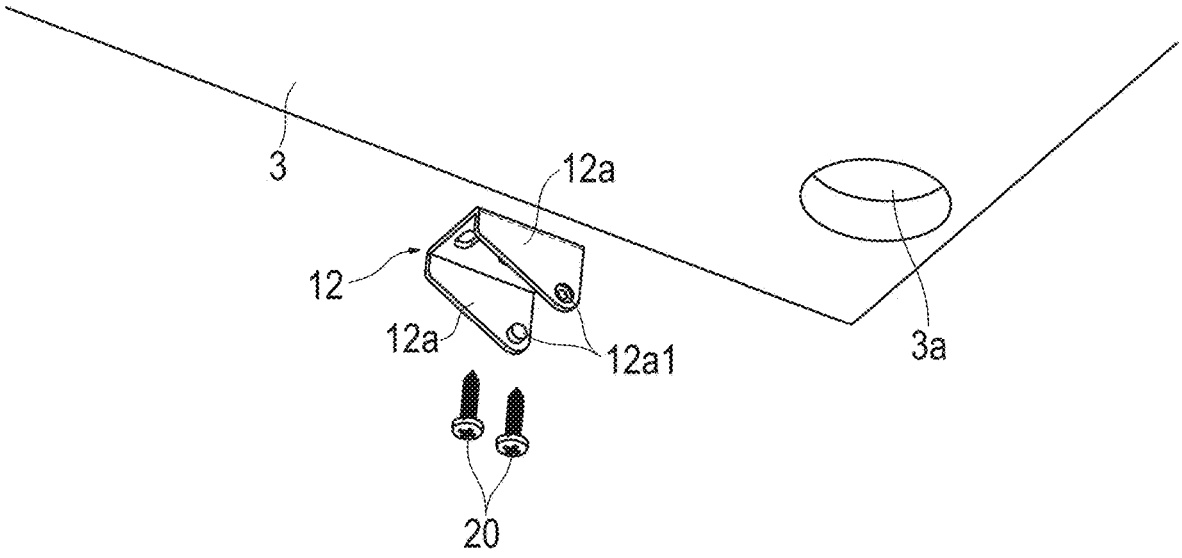
FIG. 6 is a process diagram of a method for attaching the door device of the present embodiment.
Figure 7:
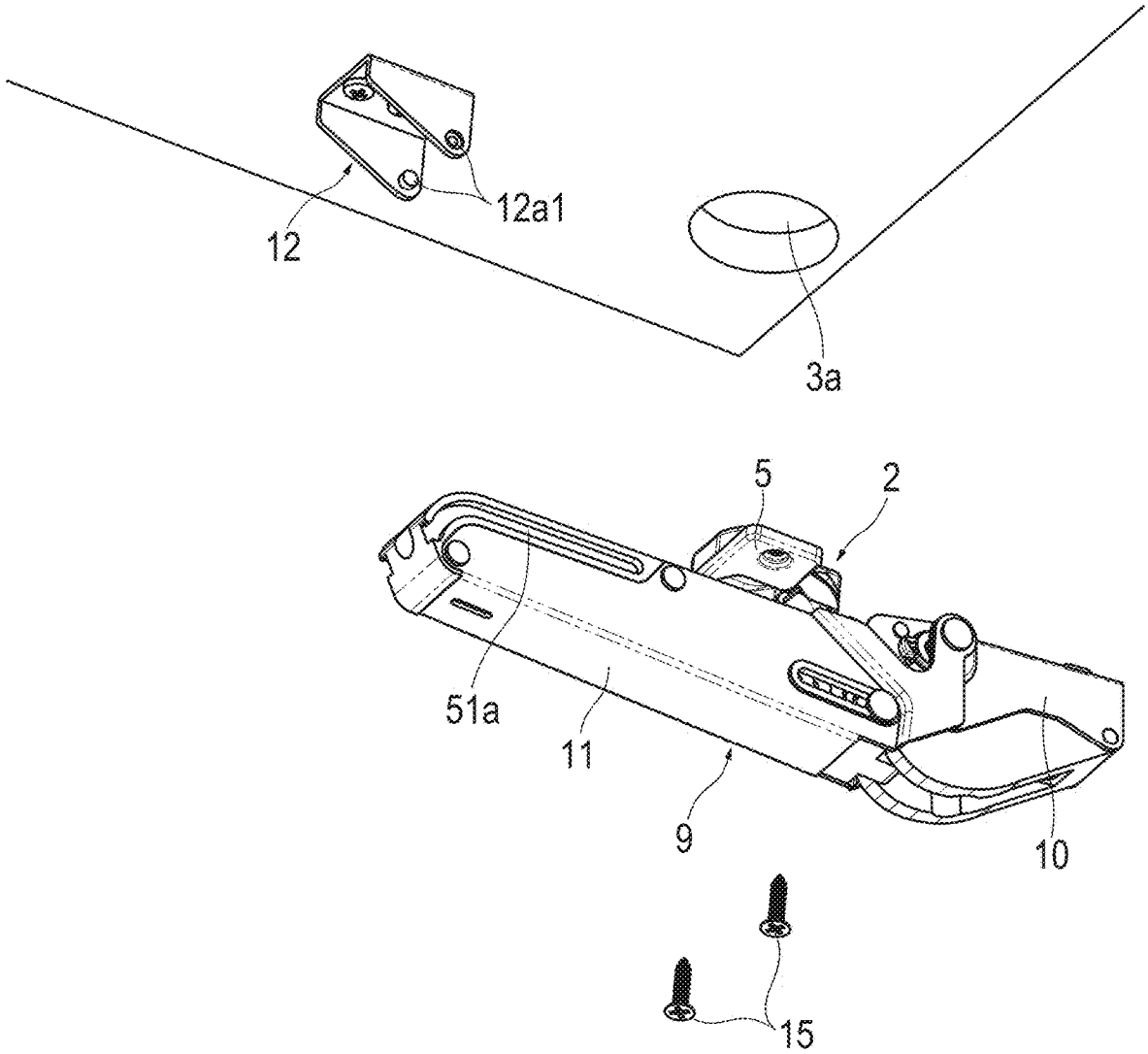
FIG. 7 is a process diagram of a method for attaching the door device of the present embodiment.

FIGS. 6 to 8 show process diagrams of a method of attaching the hinge 2 and the door device 9. First, as shown in FIG. 6, the seat 12 is attached to the door 3 using third screws 20. The door 3 is previously formed with a recess 3*a* into which the second part 5 of the hinge 2 is fitted.

As shown in FIG. 7, the door device 9 is attached to the first part main body 17 of the hinge 2. After the protrusions 12*a*1 of the seat 12 are fitted into the grooves 51*a* of the arm 11 of the door device 9, the second part 5 of the hinge 2 is attached to the door 3 using second screws 15.

As shown in FIG. 8, the mounting seat 16 of the hinge 2 is attached to the top plate 1*a* of the main body 1 using the first screws 14. When the first part main body 17 of the hinge 2 is attached to the mounting seat 16 with one touch, the door device 9 can be attached to the main body 1 and the door 3 can be attached to the main body 1 at the same time. Note that after the first part main body 17 is attached to the mounting seat 16 of the hinge 2, the door device 9 can be slid and attached to the first part main body 17.

The configuration of the door device 9 according to the first embodiment of the present invention has been described above. The door device 9 of the present embodiment has the following effects.

Since the base 10 of the door device 9 is attached to the first part 4 of the hinge 2, the hinge 2 and the door device 9 can be integrated, and a neat impression can be provided. Further, since the spring 41 is provided in the door device 9, the selection range of the spring 41 is widened, and a necessary catch function and/or assist function can be secured.

Since the first part 4 of the hinge 2 has the first part main body 17 having a U-shaped cross section and the base 10 of the door device 9 is attached to the first part main body 17, it is possible to firmly attach the base 10 of the door device 9 to the first part 4 of the hinge 2.

Since the seat 12 for connecting the arm 11 to the door 3 is apart from the second part 5 of the hinge 2, the length of the arm 11 can be lengthened, and the length of the spring 41 accommodated in the arm 11 can also be lengthened. For this reason, the selection range of the spring 41 is further widened.

Since the first part 4 of the hinge 2 has the mounting seat 16 to be fixed to the main body 1 and the first part main body 17 is detachably attached to the mounting seat 16, and the door device 9 is attached to the first part main body 17, the door device 9 which is in a state of being attached to the first part main body 17 can be attached to and detached from the mounting seat 16.

Since the cam 43 is provided on the base 10 of the door device 9, torque acting on the arm 11 can be easily controlled.

Since the concave portion 21 of the base 10 is defined by the pair of left and right side walls 22 corresponding to the pair of left and right side plates 17*a* of the first part main body 17 of the hinge 2, the base body 23, and the pair of bent portions 22*a* that are bent at the upper end portions of the pair of side walls 22 so as to sandwich the pair of side plates 17*a* in the vertical direction together with the base body 23, it is possible for the base 10 to be slidable only in the front-rear direction with respect to the first part main body 17 of the hinge 2.

Second Embodiment

Figure 9:
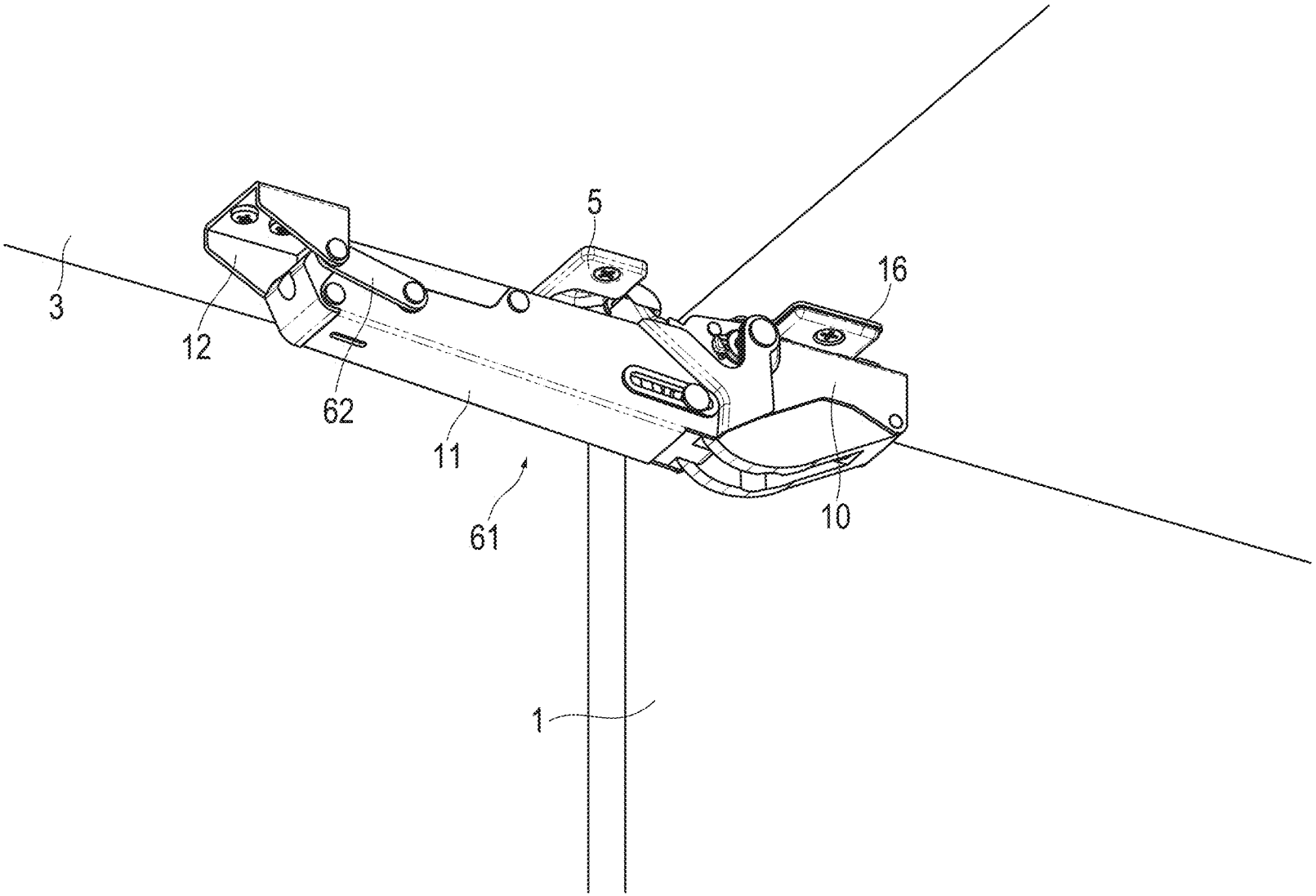
FIG. 9 is a perspective view of a door device according to a second embodiment of the present invention.

FIG. 9 shows a door device 61 according to a second embodiment of the present invention. In the first embodiment, the arm 11 is slidably and rotatably connected to the seat 12 attached to the door 3. In the second embodiment, the arm 11 is connected to the door 3 via links 62. One end of each link 62 is rotatably connected to the seat 12. The other end of the link 62 is rotatably connected to the arm 11. The other configurations of the hinge 2 and the door device 61 are substantially the same as those of the first embodiment, and thus the same reference numerals are given and the description thereof is omitted.

Third Embodiment

Figure 10:
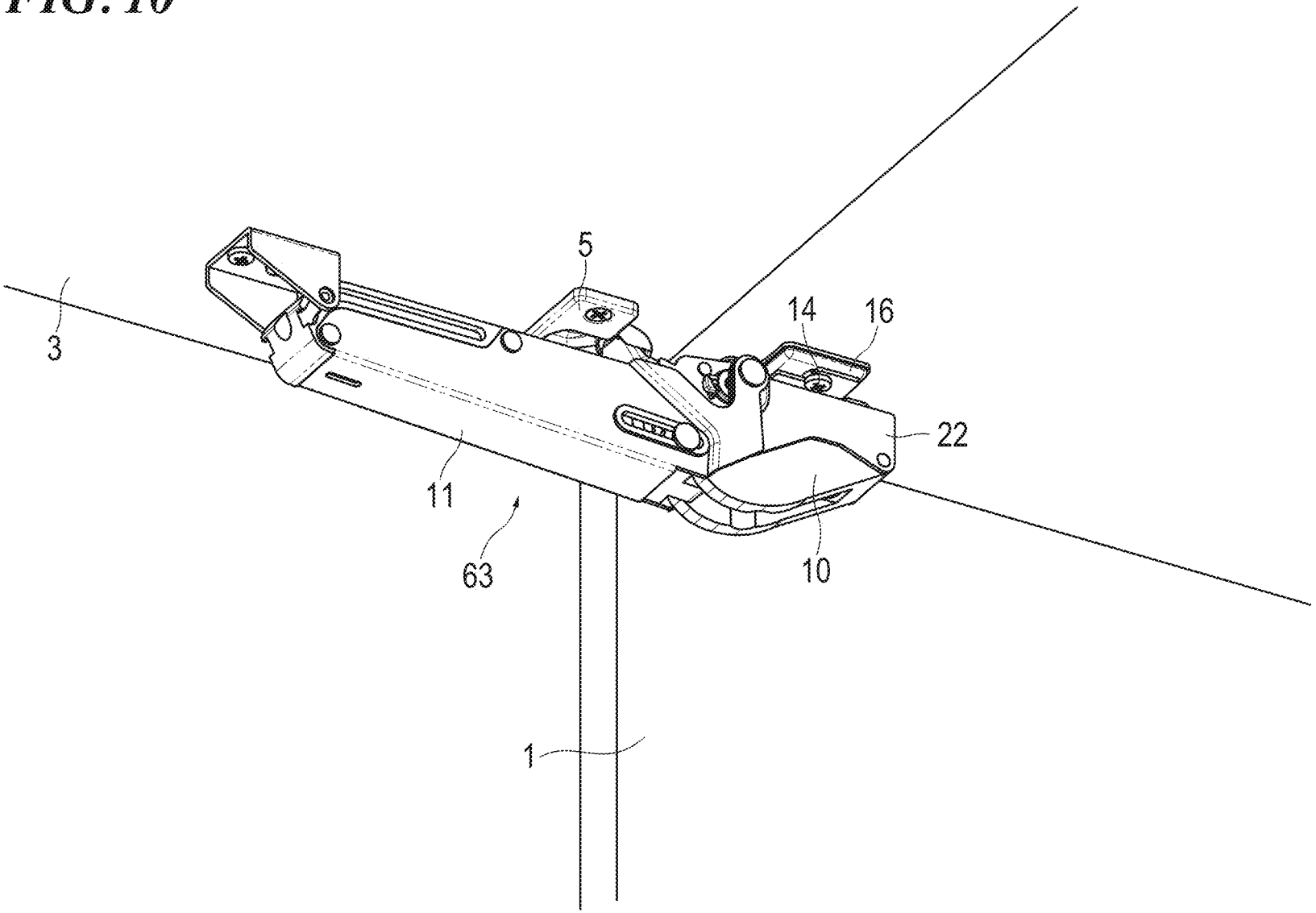
FIG. 10 is a perspective view of a door device according to a third embodiment of the present invention.
Figure 11:
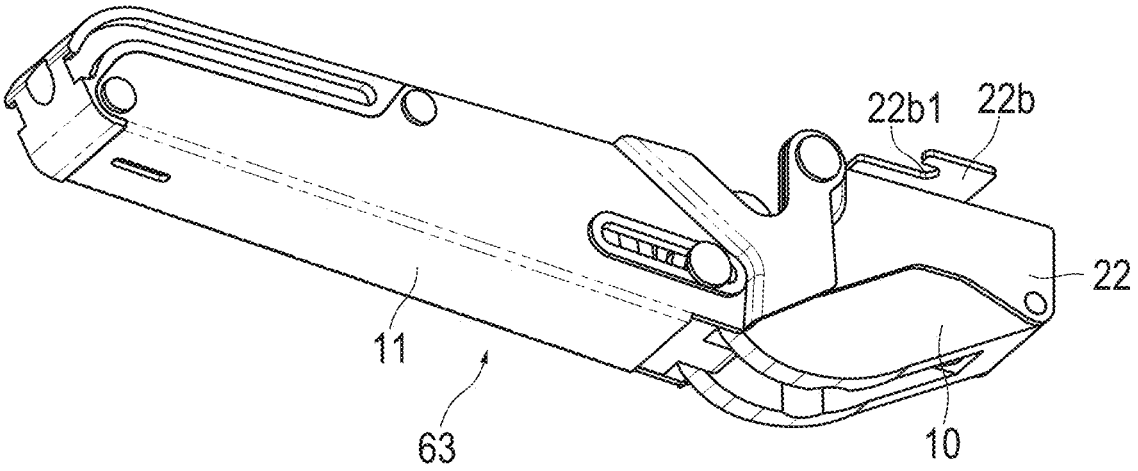
FIG. 11 is a perspective view of the door device according to the third embodiment of the present invention (when removed from the hinge).
Figure 12:
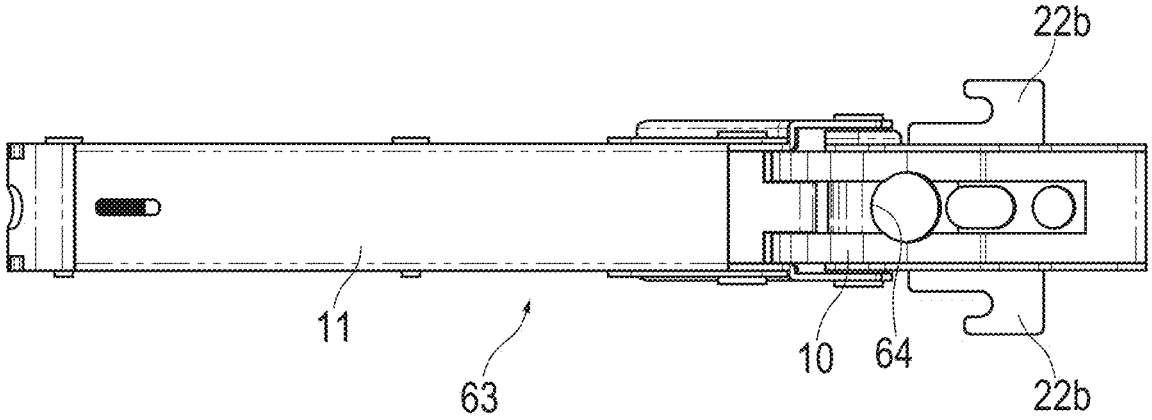
FIG. 12 is a bottom view of the door device according to the third embodiment of the present invention.

FIGS. 10 to 12 show a door device 63 according to a third embodiment of the present invention. In the first embodiment, the base 10 of the door device 9 is attached to the first part main body 17 of the first part 4 of the hinge 2. In the third embodiment, as shown in FIGS. 10 and 11, the base 10 of the door device 63 is attached to the mounting seat 16 of the first part 4 of the hinge 2. Each of the side walls 22 of the base 10 is formed with a locking piece 22*b* that is bent outward. A groove 22*b*1 into which the first screw 14 is fitted is formed in each locking piece 22*b*. The base 10 and the mounting seat 16 are fastened together with the main body 1 by the first screws 14. As shown in FIG. 12, the base 10 is formed with an access opening 64 such as a hole or notch instead of the set screw 34 (see FIG. 4). Since the other configurations of the hinge 2 and the door device 63 are substantially the same as those of the first embodiment, the same reference numerals are given and description thereof is omitted.

Fourth Embodiment

Figure 13:
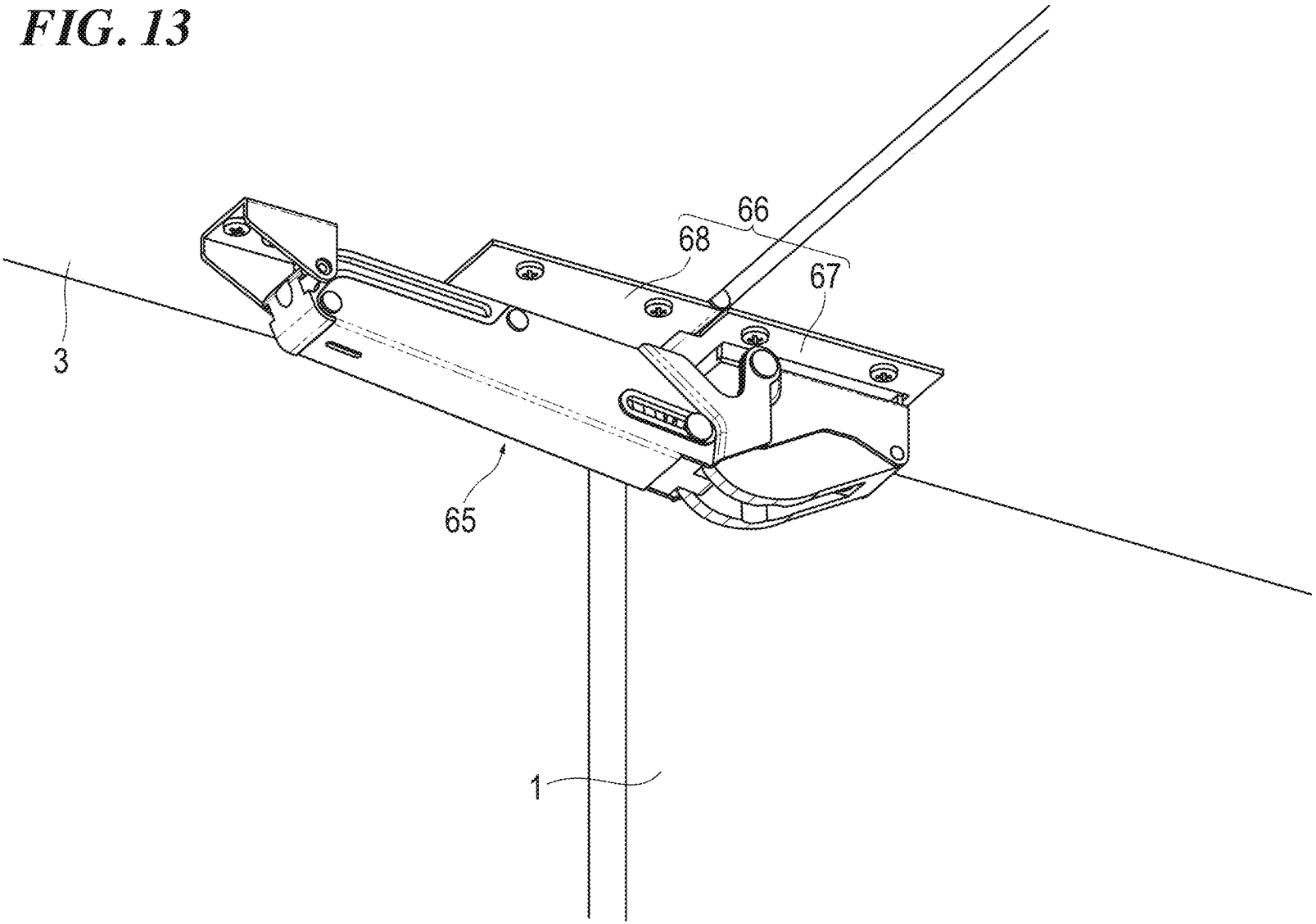
FIG. 13 is a perspective view of a door device according to a fourth embodiment of the present invention.
Figure 14:
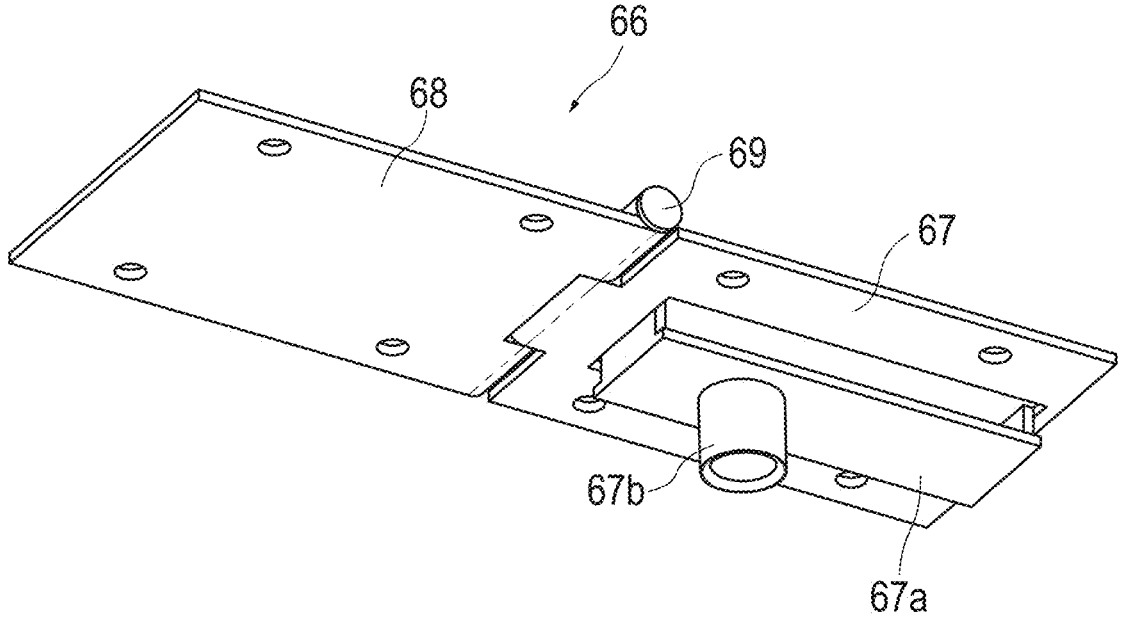
FIG. 14 is a perspective view of a uniaxial hinge.

FIG. 13 shows a door device 65 according to a fourth embodiment of the present invention. In the first embodiment, the base 10 of the door device 9 is attached to the first part main body 17 of the slide hinge 2. In the fourth embodiment, the base 10 of the door device 65 is attached to a first portion 67 of a uniaxial hinge 66. As shown in FIG. 14, the uniaxial hinge 66 includes a substantially plate-like first portion 67 to be attached to the main body 1, a substantially plate-like second part 68 to be attached to the door 3, and a shaft 69 inserted into a cylindrical part of the first portion 67 and a cylindrical portion of the second portion 68. The first portion 67 is formed with a seat 67*a* into which the base 10 of the door device 65 is slidably fitted. The seat 67*a* is formed into a plate shape that protrudes downward from the first portion 67. A cylindrical body 67*b* into which the set screw 34 (see FIG. 4) is fitted is formed integrally with the seat 67*a*. The door device 65 is attached to the first portion 67 of the uniaxial hinge 66 by fitting the base 10 of the door device 65 to the seat 67*a* and fitting the set screw 34 to the cylindrical body 67*b*.

Fifth Embodiment

Figure 15:
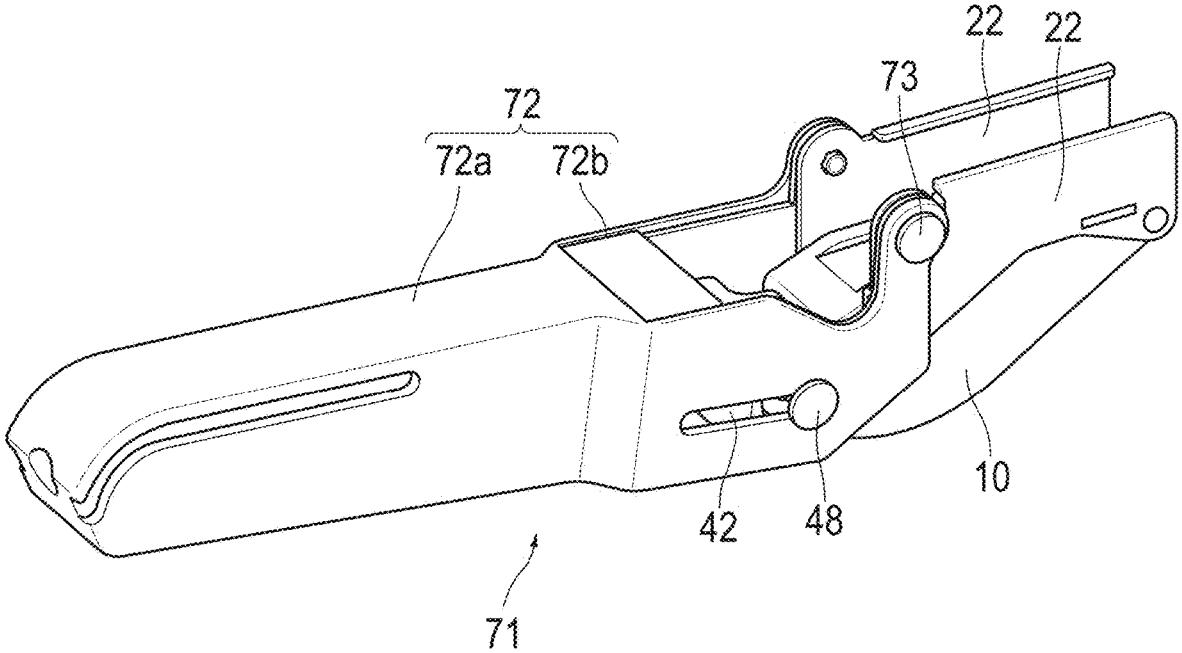
FIG. 15 is a perspective view of a door device according to a fifth embodiment of the present invention.

FIG. 15 shows a door device 71 according to a fifth embodiment of the present invention. In the first embodiment, as shown in FIG. 4, the arm 11 has a U-shaped cross section and is made of metal. In the fifth embodiment, as shown in FIG. 15, the arm 72 includes a metal base frame 72*b* having a U-shaped cross section and a resin main body frame 72*a* having a substantially square cross section and a substantially cylindrical shape. The metal base frame 72*b* is fitted inside the resin main body frame 72*a* and is fixed to the main body frame 72*a*. The base frame 72*b* is rotatably supported on the side walls 22 of the base 10 via axes 73. The main body frame 72*a* is rotatably supported on the side walls 22 of the base 10 via the axes 73 in the same manner as the base frame 72*b*. The guide bodies 45 and the spring case 51 shown in FIG. 4 are integrally resin-molded with the main body frame 72*a*. In the main body frame 72*a*, the spring 41, the spring receiver 49, and the screw 50 shown in FIG. 4 are provided. Further, the slider 42 biased by the spring 41 is provided in the main body frame 72*a* so as to be slidable via the pin 48.

Sixth Embodiment

Figure 16:
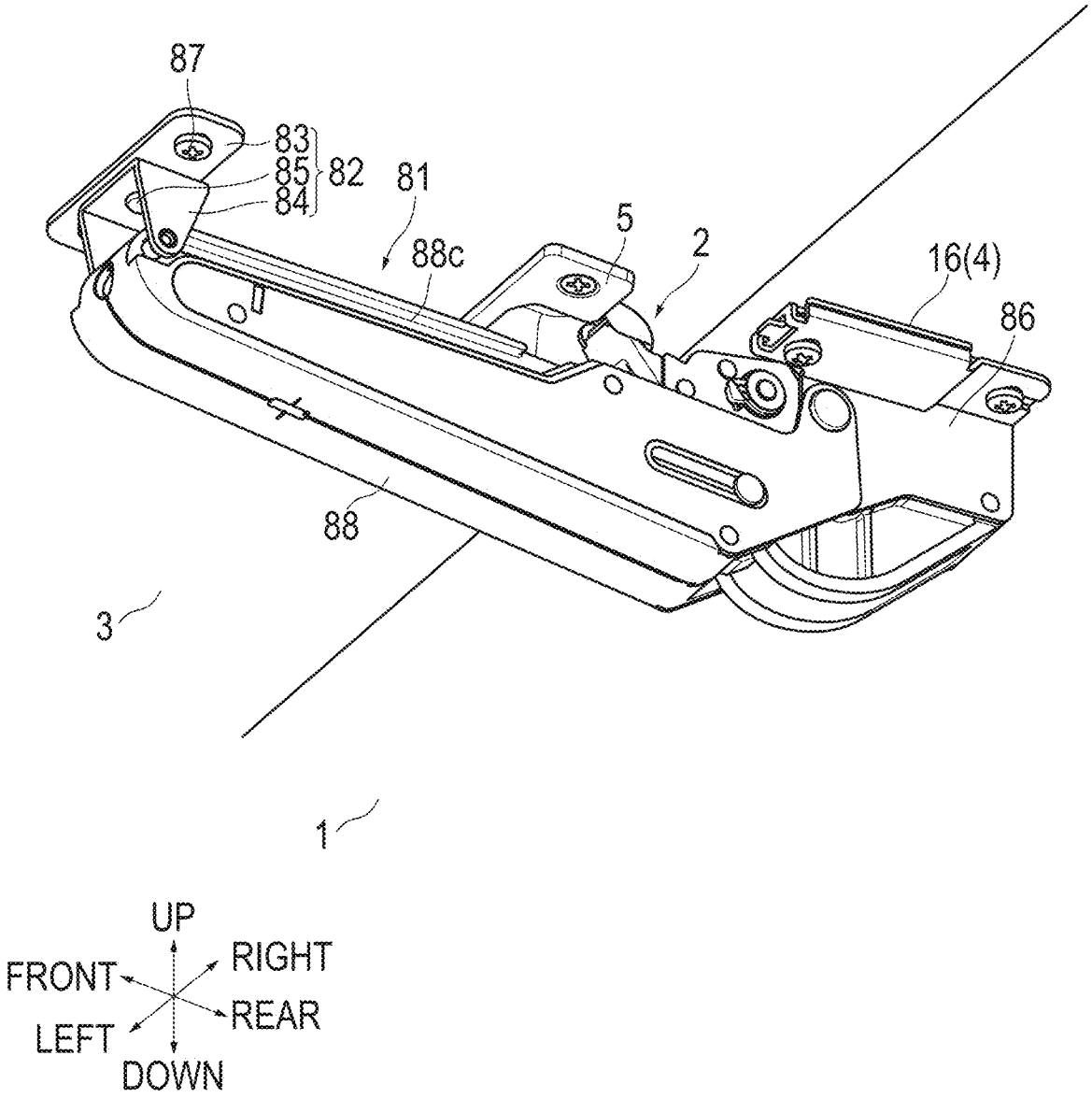
FIG. 16 is a perspective view of a door device according to a sixth embodiment of the present invention.

FIG. 16 shows a door device 81 according to a sixth embodiment of the present invention. The door device 81 of the sixth embodiment and the door device 9 of the first embodiment are mainly different in the following two points. First, in the door device 81 of the sixth embodiment, a seat 82 to be attached to the door 3 includes a first seat 83 and a second seat 84, and the second seat 84 is rotatable with respect to the first seat 83 around an axis 85. Second, the base 86 of the door device 81 is attached to the mounting seat 16 of the first part 4 of the hinge 2, and the position of the door 3 can be adjusted in a state that the base 86 is attached to the mounting seat 16 of the hinge 2.

Figure 17:
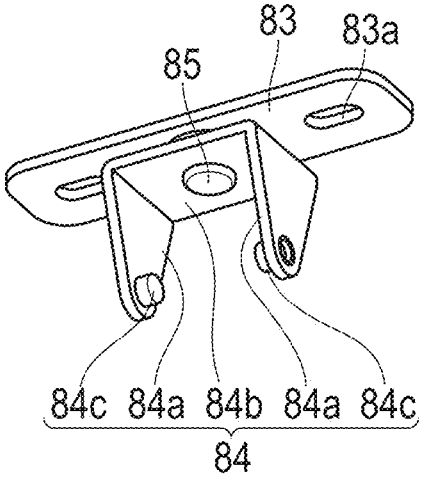
FIG. 17 is a perspective view of a seat.

First, the seat 82 of the sixth embodiment will be described. As shown in FIG. 17, the seat 82 includes the first seat 83 to be attached to the door 3, and the second seat 84 that is rotatable about the axis 85 on the first seat 83. The first seat 83 has a plate shape. The first seat 83 is formed with long slots 83*a* through which screws 87 (see FIG. 16) for attaching to the door 3 are passed. The axis 85 is fixed to the first seat 83. The axis 85 is perpendicular to the door 3. The second seat 84 is rotatably supported on the axis 85. The second seat 84 is U-shaped and includes a pair of side plate portions 84*a* facing each other and a connecting plate portion 84*b* that connects the pair of side plate portions 84*a*. On the inner side surfaces of the side plate portions 84*a*, projections 84*c* are formed so as to slidably fit in grooves 88*c* of an arm 88 (see FIG. 16).

When the seat 82 is tilted and attached to the door 3, or when the door 3 is tilted, the influence of the tilt increases as the door 3 is closed, and the sliding resistance between the seat 82 and the arm 88 increases. According to the present embodiment, even if the seat 82 and the door 3 are tilted, the second seat 84 rotates and the second seat 84 and the arm 88 are kept parallel. Since the sliding resistance between the second seat 84 and the arm 88 hardly occurs, the operation of the door device 81 can be stabilized.

The configuration of the door device 81 of the sixth embodiment is as follows. As shown in FIG. 16, the door device 81 according to the sixth embodiment is similar to the door device 9 of the first embodiment. Namely, the door device 81 includes the base 86 attached to the first part 4 of the hinge 2 and the arm 88 rotatably supported on the base 86. The seat 82 connected to the arm 88 is apart from the second part 5 of the hinge 2.

Figure 18:
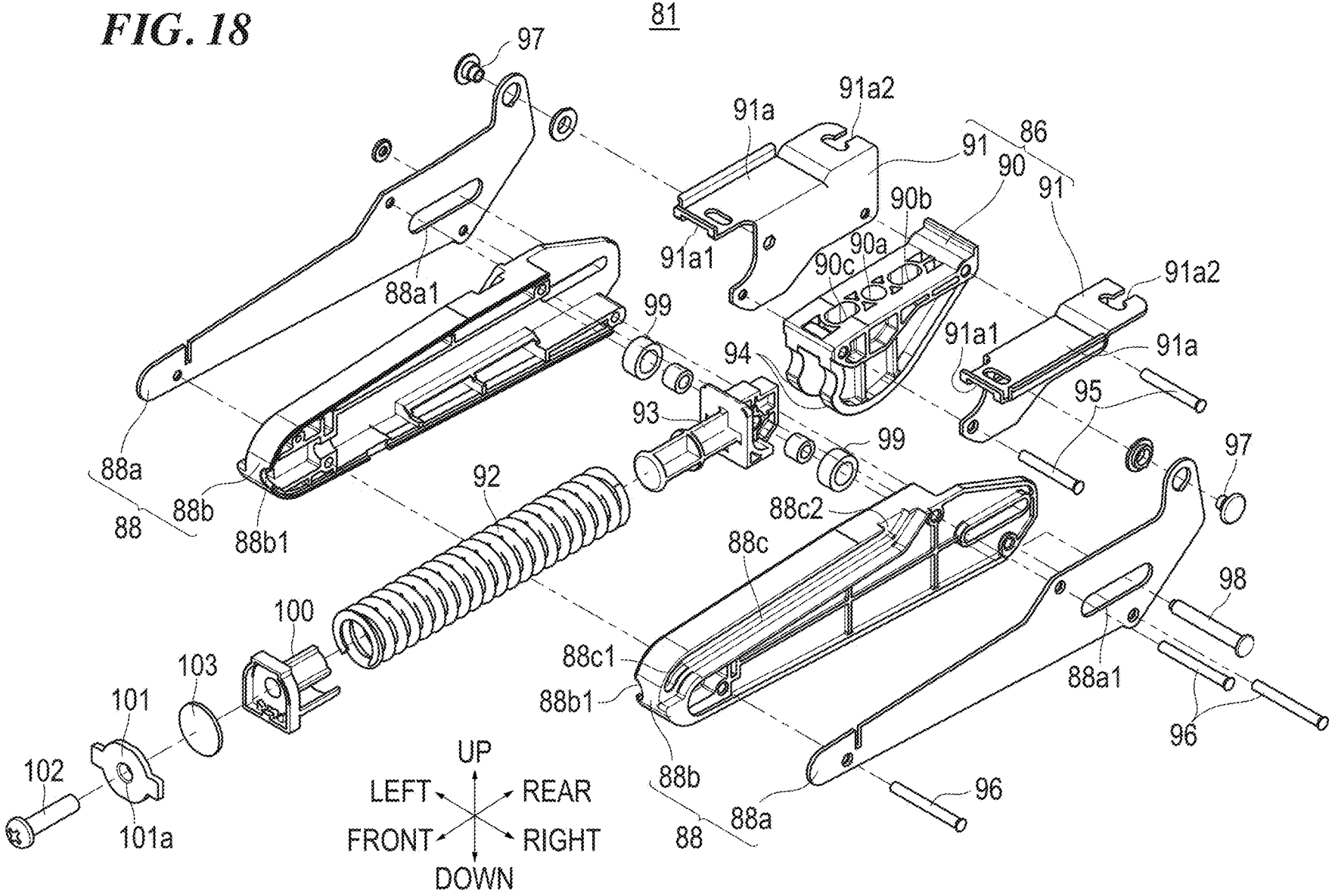
FIG. 18 is an exploded perspective view of the door device of the present embodiment.

FIG. 18 shows an exploded perspective view of the door device 81. The reference numeral 86 denotes the base and the reference numeral 88 denotes the arm. The arm 88 accommodates a spring 92 that applies torque in the closing direction and opening direction to the arm 88. Also, a slider 93 is accommodated in the arm 88 so as to be slidable in the lengthwise direction of the arm 88. The slider 93 is biased to a cam 94 of the base 86 by the spring 92. The cam 94 converts the force by which the spring 92 presses the slider 93 into torque that rotates the arm 88.

The base 86 includes a base body 90 in which the cam 94 is formed, and a pair of left and right side plates 91 respectively attached to the left and right side surfaces of the base body 90. The pair of side plates 91 are formed symmetrically about the base body 90 as a center. The base body 90 and the side plates 91 are coupled by coupling means such as swage pins 95. The upper plate portion 91*a* of each side plate 91 is bent outward so that the base 86 can be attached to the mounting seat 16 (see FIGS. 16 and 20 A) that is wide in the left-right direction. Each of the upper plate portions 91*a* is formed with an opening 91*a*1 that fits into the protrusion 16*a* (see FIG. 20A) at the distal end portion of the mounting seat 16. Further, each upper plate portion 91*a* is formed with an open groove 91*a*2 that is caught by the head of each of screws 96 that are screwed to the rear end portion of the mounting seat 16.

The cam 94 is formed on the base body 90. The base body 90 is formed with access openings 90*a*, 90*b* and 90*c* such as holes, notches, etc. so as to be able to access the position adjusting screws 31, 32 and 33 (see FIG. 20A) of the hinge 2 in a state that the base 86 is attached to the mounting seat 16. The position adjustment of the hinge 2 will be described later.

The arm 88 includes a pair of left and right plate-like outer arms 88*a* and a pair of left and right case-like inner arms 88*b*. The outer arms 88*a* are made of metal. The inner arms 88*b* are made of resin. The outer arms 88*a* and the inner arms 88*b* are coupled by coupling means such as pins 96.

Each outer arm 88*a* is rotatably supported by the base 86 via an axis 97. The shaft-like slider 93 is slidably accommodated in the inner arms 88*b*. Rollers 99 are rotatably supported by the slider 93 via a pin 98. Each roller 99 is biased by the cam 94. The pin 98 is inserted through the long hole 88*a*1 of each of the outer arms 88*a*. The linear movement of the slider 93 is guided by the outer arms 88*a* through the pin 98.

A groove 88*c* into which the protrusion 84*c* of the seat 82 is slidably fitted is formed on the outer surface of each of the inner arms 88*b*. The groove 88*c* extends along each of the inner arms 88*b*. The distal end portion 88*c*1 of each groove 88*c* is curved downward in an arc shape. The base end portion 88*c*2 of each groove 88*c* is curved upward in an arc shape and opens.

The inner arms 88*b* accommodate a coiled spring 92 that biases the slider 93 toward the cam 94. One end of the spring 92 abuts on the slider 93. A spring receiver 100 abuts on the other end of the spring 92. The spring receiver 100 can slide in the inner arms 88*b*. A plate nut 101 is accommodated in the inner arms 88*b*. A screw hole 101*a* is formed in the plate nut 101. A screw 102 is screwed into the plate nut 101. The tip of the screw 102 abuts against the spring receiver 100 via a reinforcing plate 103. An adjustment hole 88*b*1 for operating the screw 102 is formed at the tip of the inner arms 88*b*.

Figure 19A:
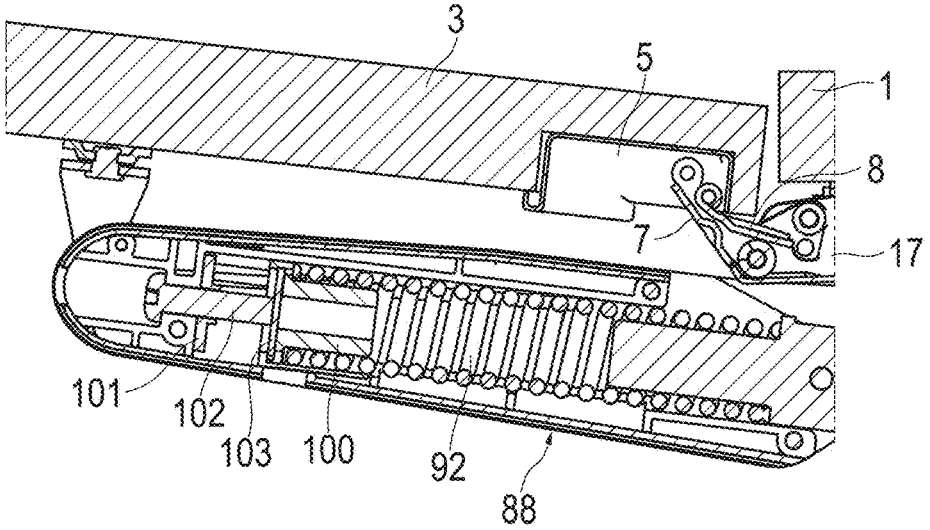
(FIG. 19A shows a state where the spring force is maximized.
Figure 19B:
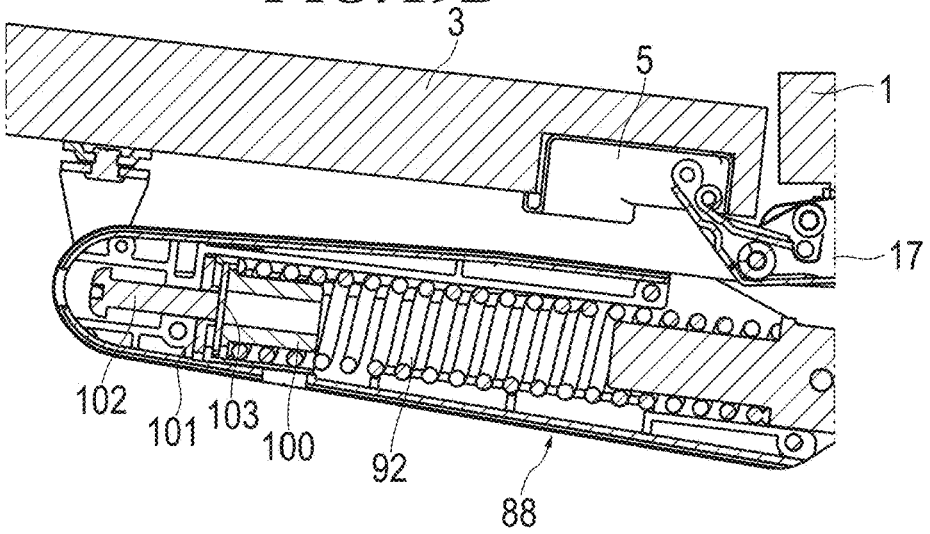
FIG. 19B shows a state where the spring force is minimized.
Figure 19C:
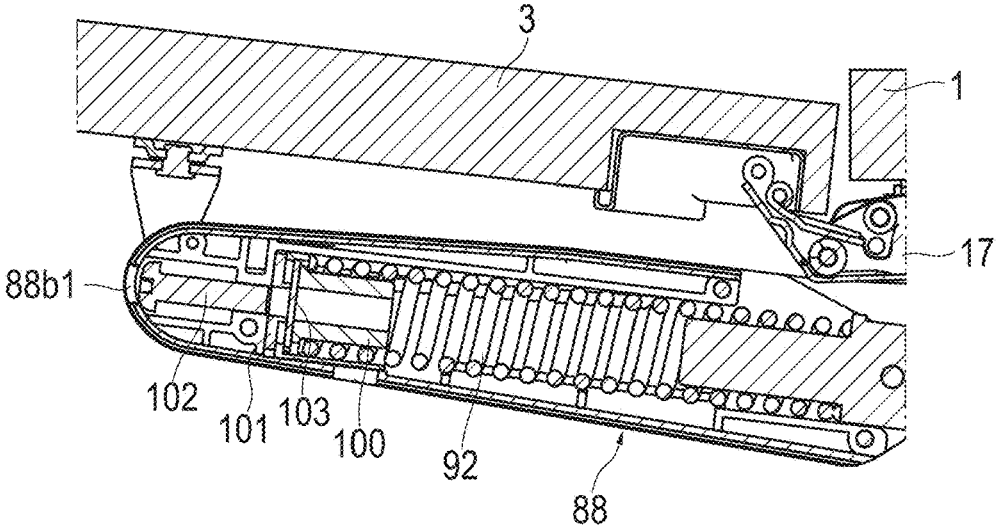
FIG. 19C shows a state where the screw is unscrewed from the plate nut).

The force of the spring 92 is adjusted by the screw 102. FIG. 19A shows a state where the force of the spring 92 is maximized, FIG. 19B shows a state where the force of the spring 92 is minimized, and FIG. 19C shows a state where the screw 102 is detached from the plate nut 101. When the screw 102 that is screwed into the plate nut 101 is rotated, the distance between the plate nut 101 and the spring receiver 100 is adjusted. The plate nut 101 is in contact with the inner arms 88*b*. When the screw 102 is rotated, the spring receiver 100 moves in the lengthwise direction of the arm 88, and thus the length of the spring 92 is adjusted. As shown in FIG. 19C, the size of the adjustment hole 88*b*1 is smaller than the head of the screw 102. For this reason, even if the screw 102 is detached from the plate nut 101, the screw 102 does not fall off from the arm 88. When the screw 102 is tightened, the screw 102 returns to the state where it is screwed into the plate nut 101 as shown in FIGS. 19A and 19B.

Figure 20A:
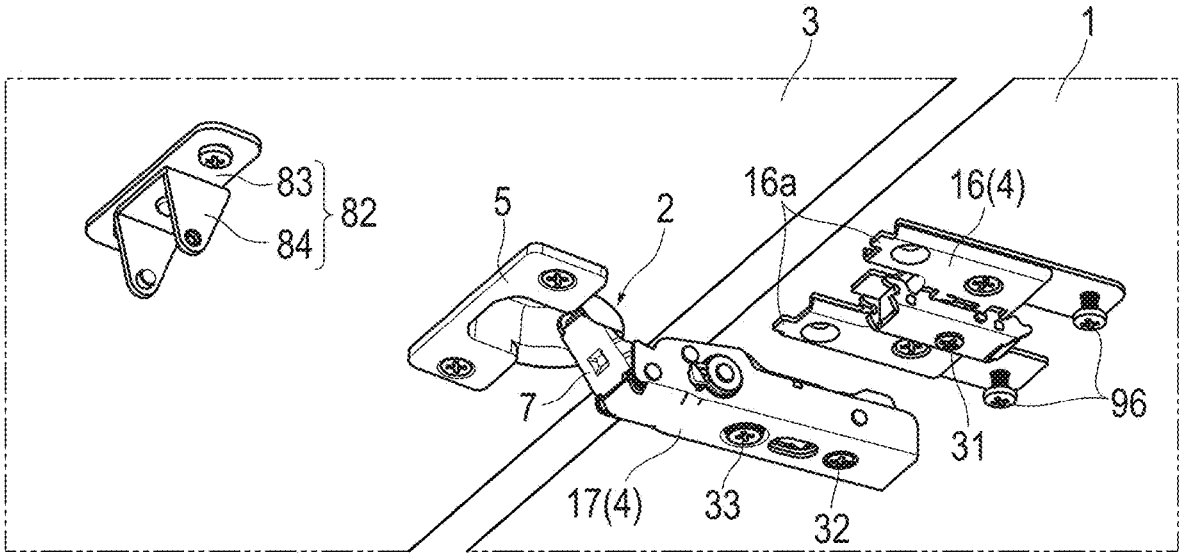
FIG. 20 is a process diagram of a method for attaching the door device of the present embodiment.

Hereinafter, a method of attaching the door device 81 of the sixth embodiment will be described. First, as shown in FIG. 20A, the mounting seat 16 of the first part 4 of the hinge 2 is attached to the main body 1, and the second part 5 and the seat 82 of the hinge 2 are attached to the door 3. The hinge 2 has substantially the same configuration as that of the first embodiment. That is, the hinge 2 is a slide hinge, and includes the first part 4, the second part 5, the inner link 7 and the outer link 8 that are rotatably connected to the first part 4 and the second part 5 (see FIG. 19A). The first part 4 includes the mounting seat 16 and the first part main body 17 that is detachably attached to the mounting seat 16 with one touch.

The screws 96 for attaching the door device 81 to the mounting seat 16 are screwed into the mounting seat 16 of the hinge 2. The screws 96 are not completely screwed in but they are screwed in a little.

Figure 20B:
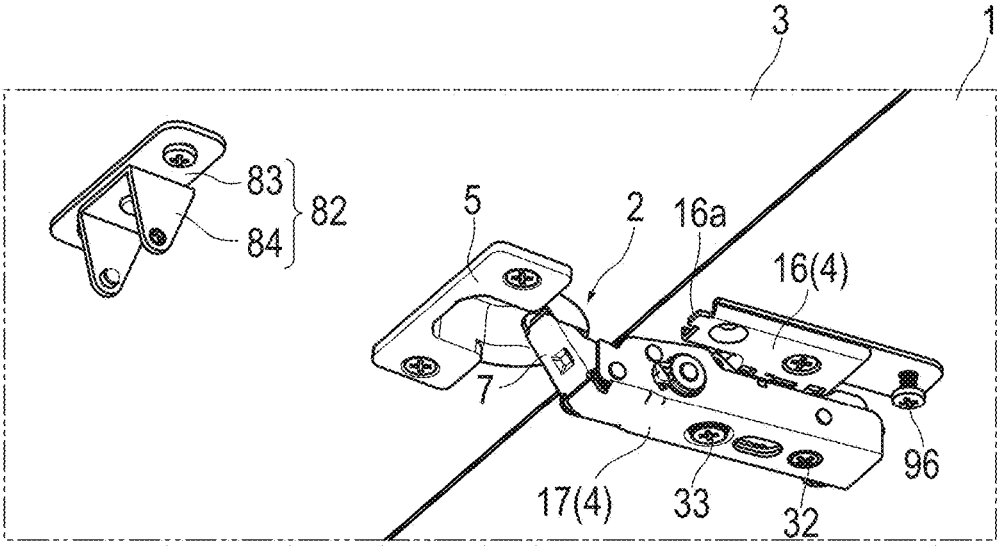

Next, as shown in FIG. 20B, the first part main body 17 is attached to the mounting seat 16, and the door 3 is assembled to the main body 1. In this state, the left-right adjustment, the vertical adjustment (coverage amount adjustment), and the front-rear adjustment of the door 3 are performed. By rotating the left-right adjustment screw 31 shown in FIG. 20A, the left-right position of the first part main body 17 and thus the left-right position of the door 3 can be adjusted. By rotating the front-rear adjustment screw 32 shown in FIG. 20B, the position of the first part main body 17 in the front-rear direction, and thus the position of the door 3 in the front-rear direction can be adjusted. By rotating the vertical adjustment screw 33 shown in FIG. 20B, the vertical position of the first part main body 17 and thus the vertical position of the door 3 can be adjusted.

Figure 21A:
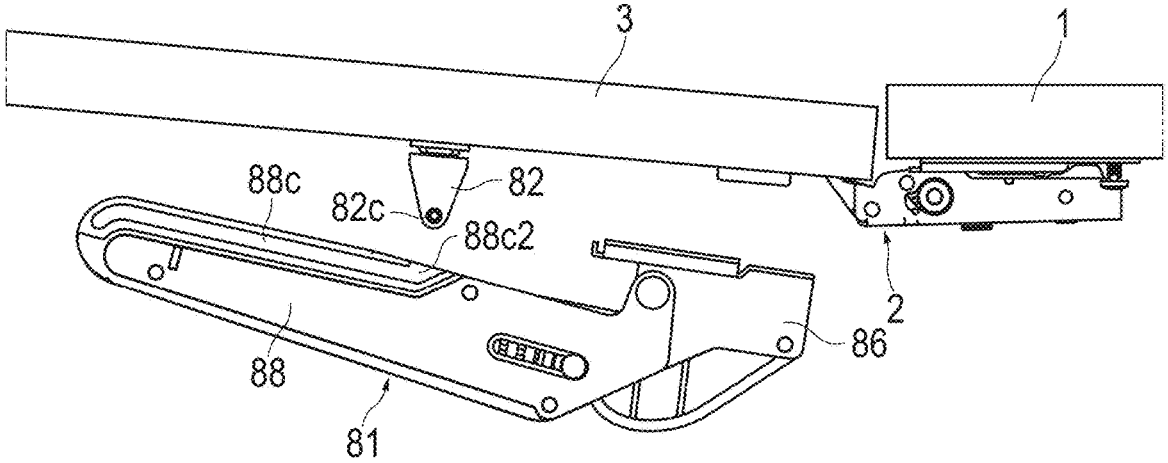
FIG. 21 is a process diagram of a method for attaching the door device of the present embodiment.
Figure 21B:
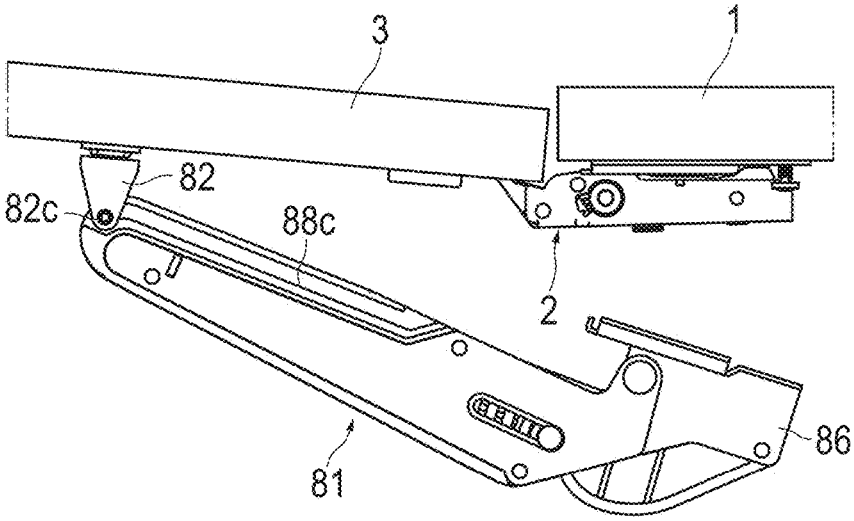

Next, as shown in FIG. 21A, the door device 81 is brought close to the seat 82 so that the protrusions 82*c* of the seat 82 enter the base end portions 88*c*2 of the grooves 88*c* of the arm 88 of the door device 81. Then, as shown in FIG. 21B, the protrusions 82*c* of the seat 82 are moved to the tip end portions 88*c*1 of the grooves 88*c*.

Figure 22A:
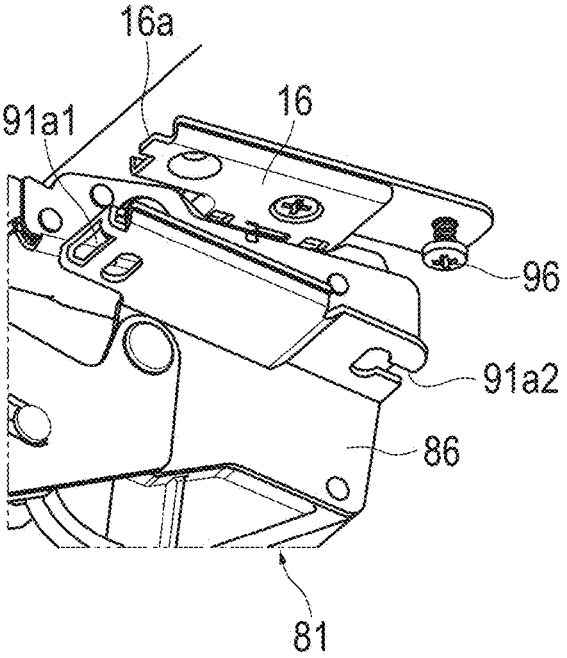
FIG. 22 is a process diagram of a method for attaching the door device of the present embodiment.
Figure 22B:
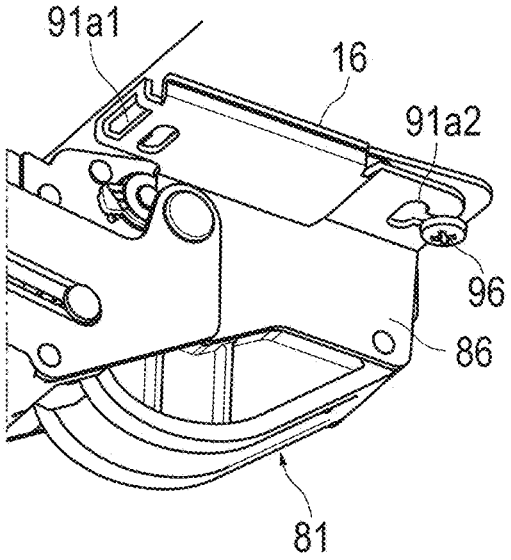
Figure 22C:
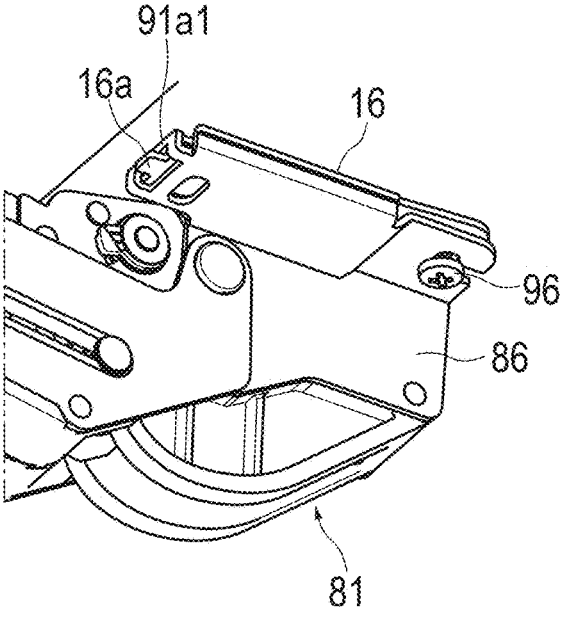
Figure 22D:
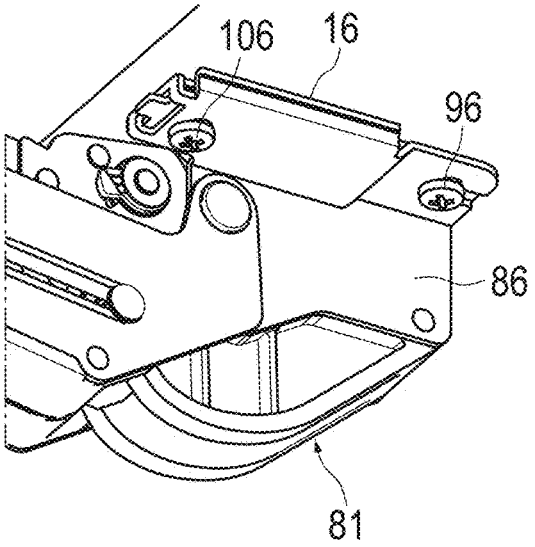

Next, as shown in FIGS. 22A to 22B, the opening grooves 91*a*2 of the base 86 of the door device 81 are hooked on the screws 96, and the base 86 is moved as shown in FIG. 22C. The openings 91*a*1 of the base 86 are hooked on the protrusions 16*a* at the tip of the mounting seat 16 by moving the base 86 backward. In this state, the door 3 is in the open position, and the door device 81 is temporarily held by the mounting seat 16. Next, as shown in FIG. 22D, the screws 96 and 106 are fastened to the main body 1, and the base 86 is attached to the mounting seat 16. Since the door 3 is held in the open state, it is possible to release the hand from the door 3 and perform the screwing operation.

Figure 23A:
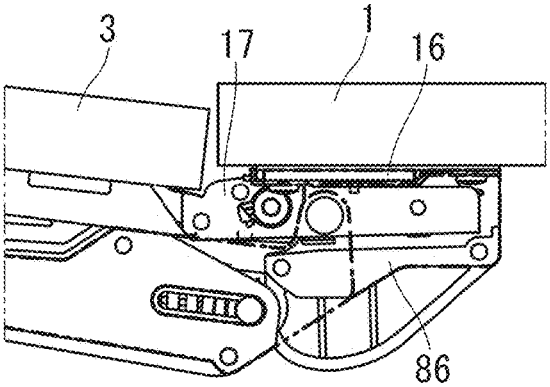
FIG. 23 is a diagram showing position adjustment of the hinge in the front-rear direction and the vertical direction.
Figure 23B:
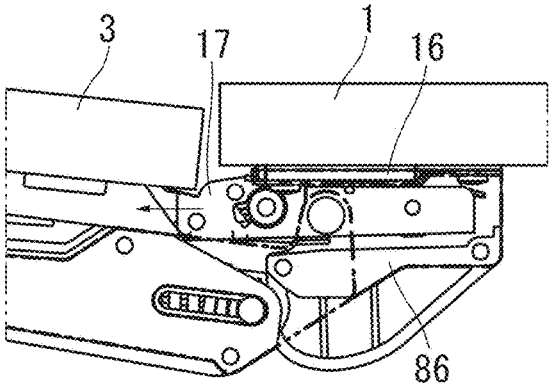
Figure 23C:
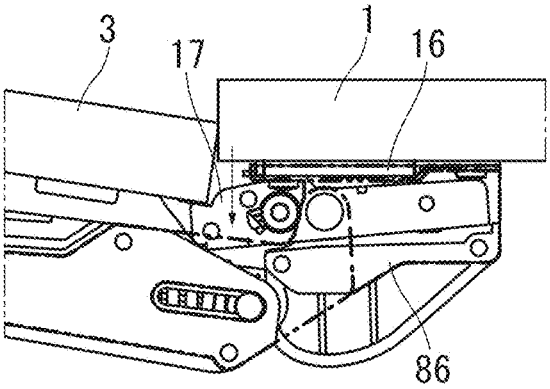
Figure 23D:
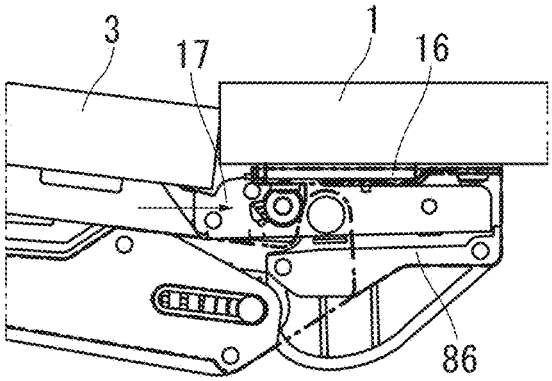

The position adjustment of the hinge 2 after the door device 81 is attached to the mounting seat 16 is performed as follows. FIG. 23A shows a state before the position adjustment of the first part main body 17, FIG. 23B shows a state after the position adjustment of the first part main body 17 in the forward direction, FIG. 23C shows a state after the position of the first part main body 17 is adjusted downward, and FIG. 23D shows a state after the position of the first part main body 17 is adjusted backward. By rotating the above-described front-rear and vertical adjustment screws 32 and 33 are rotated, the first part main body 17 can move in the front-rear direction and the vertical direction.

The base 86 of the door device 81 is attached to the mounting seat 16. The base 86 is formed into a shape that does not interfere with the first part main body 17 even if the first part main body 17 moves in the front-rear direction and the vertical direction. For this reason, in the state that the base 86 is attached to the mounting seat 16 with the screws 96, the position of the first part main body 17 and thus the door 3 in the front-rear direction and the vertical direction can be adjusted.

Figure 24A:
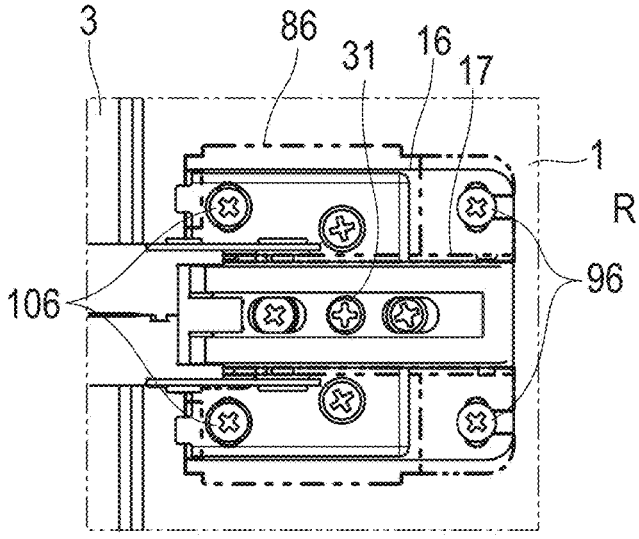
FIG. 24 is a diagram showing adjustment of the position of the hinge in the left-right direction.
Figure 24B:
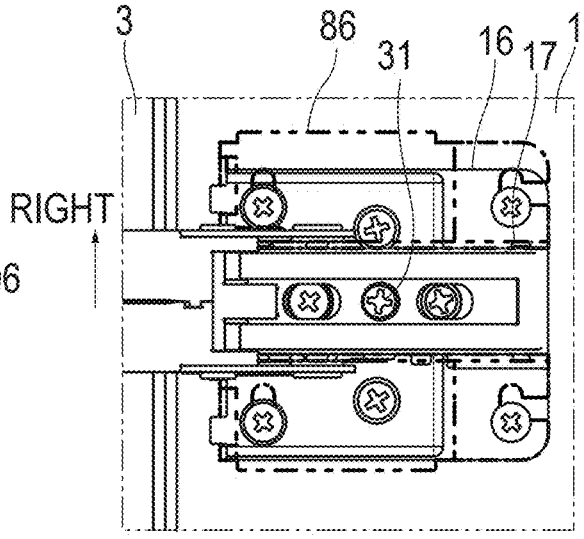
Figure 24C:
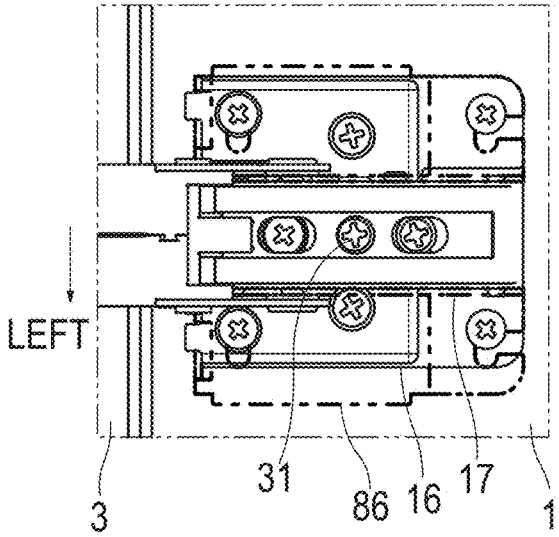

FIG. 24 shows a bottom view of the base 86. FIG. 24A shows the state before the position adjustment of the first part main body 17, FIG. 24B shows the state after the position of the first part main body 17 is adjusted in the right direction, and FIG. 24C shows the state after the position of the first part main body 17 is adjusted to the left direction. When adjusting the position of the first part main body 17 in the left-right direction, the screws 96 and 106 are loosened, and the base 86 is also loosened from the mounting seat 16. Then, the left-right adjustment screw 31 is rotated. After adjustment, the screws 96 and 106 are tightened again. Thereby, the position of the first part main body 17 in the left-right direction can be adjusted together with the base 86 and the position of the door 3 in the left-right direction can also be adjusted.

The present invention is not limited to the embodiments described above, and can be embodied in various embodiments without departing from the scope of the present invention.

In the above embodiments, although the first part of the hinge to which the door device is attached is attached to the main body and the second part of the hinge is attached to the door, the first part of the hinge may be attached to the door and the second part of the hinge may be attached to the main body.

The shape and structure of each part of the door device are mere examples, and other shapes and structures may be adopted without departing from the scope of the present invention.

For example, in the above embodiments, the arm is directly connected to the seat and the arm is connected to the door via the seat, but the arm may be directly connected to the second part of the hinge, and the arm may be connected to the door via the second part of the hinge.

In the above embodiments, the first part main body of the first part of the hinge is detachably attached to the mounting seat, but the first part main body of the first part of the hinge may be integrated with the mounting seat so as not to be separated.

In the above embodiments, the spring force is converted into torque for the arm using the slider and the cam at the base end of the arm, but the slider and the base end of the arm may be connected by links and the force of the spring may be converted into the torque for the arm using the links.

Figure 25A:
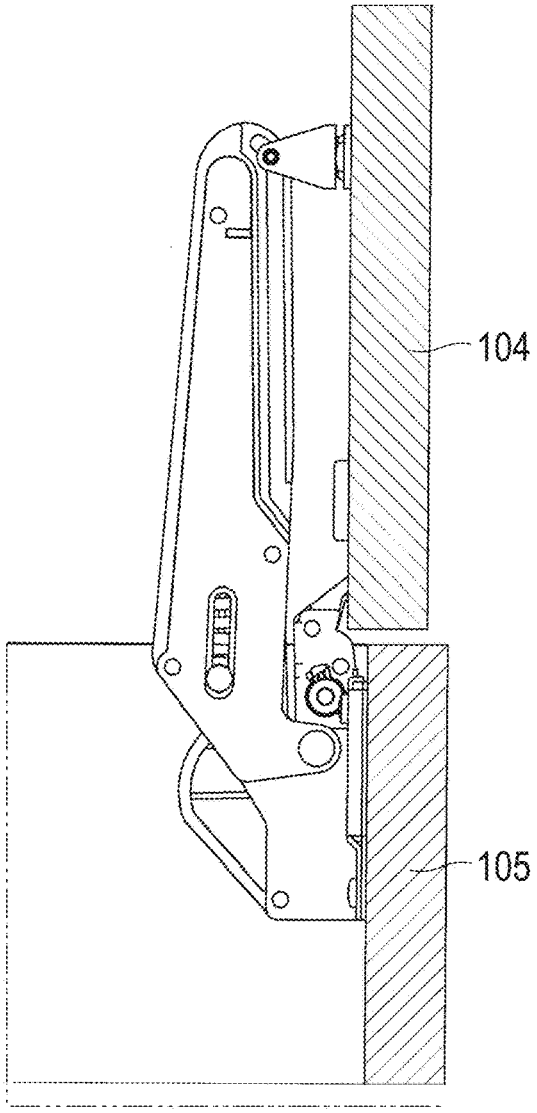
FIG. 25 is a cross-sectional view of furniture such as a cabinet in which the door device of the present embodiment is attached to an upper lid.
Figure 25B:
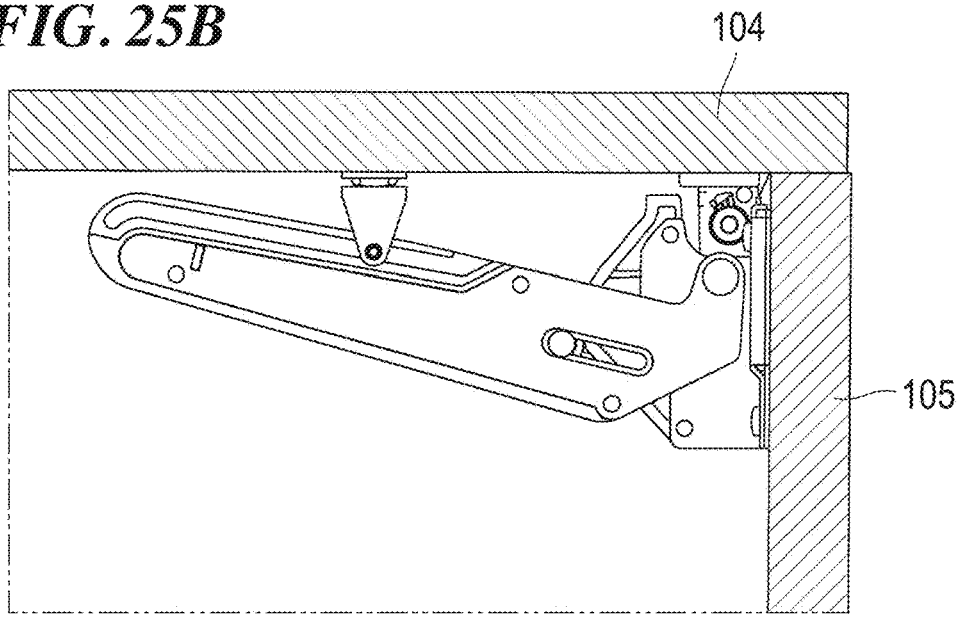

Although the above-described explanation is made with regard to the case where the door device is applied to the door of furniture, the present invention is not limited to the door of furniture and it can be applied to the door of a building, and the door of a machinery apparatus. In the above embodiments, the upwardly open type door has been described as an example, but the door may be opened left or right or opened downward. Furthermore, as shown in FIG. 25, the door device of the present embodiments can be applied to an upper lid and a lower lid. FIG. 25A shows the open position of the upper lid 104, and FIG. 25B shows the closed position of the upper lid 104. The reference numeral 105 denotes a main body.

This specification is based on Japanese Patent Application No. 2017-102850 filed on May 24, 2017. All disclosure is incorporated herein.

EXPLANATION OF REFERENCE NUMERALS

1 . . . Main body
2 . . . Slide hinge (hinge)
3 . . . Door
4 . . . First part of hinge
5 . . . Second part of hinge
9 . . . Door device
10 . . . Base
11 . . . Arm
12 . . . Seat
16 . . . Mounting seat
17 . . . First part main body
17*a* . . . Side plate
17*b* . . . Connecting plate

21 . . . Concave portion
22 . . . Side wall
22*a* . . . Bent portion
23 . . . Base body
31, 32, 33 . . . Hinge position adjustment screws
34*a*, 36, 37 . . . Access openings in base
41 . . . Spring (biasing means)
42 . . . Slider
43 . . . Cam
61 . . . Door device
63 . . . Door device
65 . . . Door device
66 . . . Uniaxial hinge (hinge)
67 . . . First part of hinge
68 . . . Second part of hinge
71 . . . Door device
72 . . . Arm
81 . . . Door device
82 . . . Seat
83 . . . First seat
84 . . . Second seat
85 . . . Axis
86 . . . Base
88 . . . Arm
90*a*, 90*b*, 90*c* . . . Base access openings
92 . . . Spring (biasing means)
93 . . . Slider
94 . . . Cam

The invention claimed is:

1. A door device for applying torque to a door in an opening direction and/or a closing direction thereof, the door being rotatably attached to a main body via a hinge, which comprises:

a base;

an arm rotatably supported by the base;

biasing means for applying torque to the arm in the opening direction and/or in the closing direction thereof, wherein the hinge comprises a first part to be attached to one of the main body or the door, and a second part to be attached to the other one of the main body or the door, wherein the base is attached to the first part of the hinge, wherein the arm is connected to the other one of the main body or the door;

a seat for connecting the arm to the other one of the main body or the door, the seat for connecting the arm to the other one of the main body or the door being located apart from the second part of the hinge, wherein the biasing means is accommodated in the arm, and wherein the arm is directly connected to the seat so as to be rotatable and slidable so that, upon opening the door, the arm is rotatable in an opening direction and the seat for connecting the arm to the other one of the main body or the door is slidable along the arm toward a tip of the arm.

2. The door device as claimed in claim 1, wherein the hinge includes a first part main body having a substantially U-shaped cross section to which the base is attached, and the first part main body includes a pair of side plates facing each other and a connecting plate connecting the pair of side plates.

3. The door device as claimed in claim 2, wherein the first part of the hinge has a mounting seat to be fixed to the main body and the first part main body detachably attached to the mounting seat, and wherein the base of the door device is attached to the first part main body.

4. The door device as claimed in claim 3, further comprising a cam provided on the base, and a slider slidable with respect to the arm and biased against the cam by the biasing means.

5. The door device as claimed in claim 3, wherein a seat for connecting the arm to the other one of the main body or the door comprises a first seat to be fixed to the other one and a second seat connected to the arm and rotatable around an axis with respect to the first seat.

6. The door device as claimed in claim 2, wherein the base has a concave portion to which the first part main body of the hinge is fitted, and the concave portion is defined by a pair of side walls corresponding to the pair of side plates of the first part main body of the hinge, a base main body corresponding to the connecting plate, and a pair of bent portions that are bent and provided on the pair of side walls so as to sandwich the pair of side plates together with the base main body.

7. The door device as claimed in claim 6, wherein a seat for connecting the arm to the other one of the main body or the door comprises a first seat to be fixed to the other one and a second seat connected to the arm and rotatable around an axis with respect to the first seat.

8. The door device as claimed in claim 2, further comprising a seat for connecting the arm to the other one of the main body or the door, wherein the seat is apart from the second part of the hinge, and the biasing means is accommodated in the arm.

9. The door device as claimed in claim 2, wherein the first part of the hinge has a mounting seat to be fixed to the main body and the first part main body detachably attached to the mounting seat, and wherein the base of the door device is attached to the first part main body.

10. The door device as claimed in claim 2, further comprising a cam provided on the base, and a slider slidable with respect to the arm and biased against the cam by the biasing means.

11. The door device as claimed in claim 2, wherein a seat for connecting the arm to the other one of the main body or the door comprises a first seat to be fixed to the other one and a second seat connected to the arm and rotatable around an axis with respect to the first seat.

12. The door device as claimed in claim 1, further comprising a cam provided on the base, and a slider slidable with respect to the arm and biased against the cam by the biasing means.

13. The door device as claimed in claim 12, wherein a seat for connecting the arm to the other one of the main body or the door comprises a first seat to be fixed to the other one and a second seat connected to the arm and rotatable around an axis with respect to the first seat.

14. The door device as claimed in claim 1, wherein the seat for connecting the arm to the other one of the main body or the door comprises a first seat to be fixed to the other one and a second seat connected to the arm and rotatable around an axis with respect to the first seat.

15. The door device as claimed in claim 1, wherein the first part of the hinge comprises a mounting seat to be fixed to the main body and a first part main body detachably attached to the mounting seat, wherein the base of the door device is attached to the mounting seat.

16. The door device as claimed in claim 1, wherein the base has access openings so that position adjustment screws of the hinge can be operated in a state that the base is attached to the first part of the hinge.

17. A door device for applying torque to a door in an opening direction and/or a closing direction thereof, the door being rotatably attached to a main body via a hinge, which comprises:

a base;

an arm rotatably supported by the base;

biasing means for applying torque to the arm in the opening direction and/or in the closing direction thereof, wherein the hinge comprises a first part to be attached to one of the main body or the door, and a second part to be attached to the other one of the main body or the door, wherein the base is attached to the first part of the hinge, and wherein the arm is connected to the other one of the main body or the door; and a cam provided on the base, and a slider slidable with respect to the arm and biased against the cam by the biasing means.

18. A door device for applying torque to a door in an opening direction and/or a closing direction thereof, the door being rotatably attached to a main body via a hinge, which comprises:

a base;

an arm rotatably supported by the base;

biasing means for applying torque to the arm in the opening direction and/or in the closing direction thereof, wherein the hinge comprises a first part to be attached to one of the main body or the door, and a second part to be attached to the other one of the main body or the door, wherein the base is attached to the first part of the hinge, and wherein the arm is connected to the other one of the main body or the door; and a seat for connecting the arm to the other one of the main body or the door, the seat comprising a first seat to be fixed to the other one and a second seat connected to the arm and rotatable around an axis with respect to the first seat.

* * * * *